US009707434B2

(12) United States Patent
Kaehler

(10) Patent No.: US 9,707,434 B2
(45) Date of Patent: Jul. 18, 2017

(54) TOTAL BODY EXERCISE SYSTEM AND METHOD

(71) Applicant: Robert J. Kaehler, Holland, PA (US)

(72) Inventor: Robert J. Kaehler, Holland, PA (US)

( * ) Notice: Subject to any disclaimer, the term of this patent is extended or adjusted under 35 U.S.C. 154(b) by 0 days.

(21) Appl. No.: 14/756,581

(22) Filed: Sep. 18, 2015

(65) Prior Publication Data

US 2017/0001063 A1 Jan. 5, 2017

Related U.S. Application Data

(63) Continuation of application No. 13/694,574, filed on Dec. 13, 2012, now Pat. No. 9,205,297.

(Continued)

(51) Int. Cl.

| | |
|---|---|
| ***A63B 21/02*** | (2006.01) |
| ***A63B 21/04*** | (2006.01) |
| ***A63B 21/00*** | (2006.01) |
| ***A63B 21/055*** | (2006.01) |
| ***A63B 23/035*** | (2006.01) |

(Continued)

(52) U.S. Cl.

CPC ..... *A63B 21/15* (2013.01); *A63B 21/02* (2013.01); *A63B 21/0428* (2013.01); *A63B 21/0552* (2013.01); *A63B 21/4034* (2015.10); *A63B 21/4035* (2015.10); *A63B 23/0355* (2013.01); *A63B 23/03508* (2013.01); *A63B 23/03525* (2013.01); *A63B 23/03575* (2013.01); *A63B 23/0417* (2013.01); *A63B 23/0494* (2013.01); *A63B 23/1209* (2013.01); *A63B 23/1218* (2013.01); *A63B 23/1263* (2013.01); *A63B 2208/0204* (2013.01);

(Continued)

(58) Field of Classification Search

CPC ..... A63B 21/00; A63B 21/00058; A63B 21/00061; A63B 21/00065; A63B 21/02; A63B 21/04; A63B 21/0407; A63B 21/0428; A63B 21/055; A63B 21/0552; A63B 21/0557; A63B 21/15; A63B 5/00

USPC ..... 482/44, 49, 77, 92, 121–123, 125–126, 482/129–130

See application file for complete search history.

(56) References Cited

U.S. PATENT DOCUMENTS 3,268,225 A * 8/1966 Kolbel ..... A63B 21/00043 482/126

3,427,021 A * 2/1969 Donato ..... A63B 69/20 473/441

(Continued)

*Primary Examiner* — Stephen Crow
*Assistant Examiner* — Garrett Atkinson

(57) ABSTRACT

An exercise device and methods for performing physical exercise that improve strength, conditioning, and flexibility of an operator in a functional way using multiple body positions and exercising multiple muscle groups while keeping the spine in a safe and natural position, being simple to manufacture and use, and being compact and portable. The exercise device includes an elongated member, a hollow member, handles, a foot board system, and at least one resistance band. A resistance band is secured to the elongated member and the hollow member, and slidable movement of the hollow member and the elongated member relative to each other by the operator stretches a resistance band, which creates resistance to the movement, thereby exercising, strengthening, and conditioning the operator. The operator may use the exercise device in a number of configurations to perform a number of exercises in a number of body positions.

35 Claims, 35 Drawing Sheets

Related U.S. Application Data

(60) Provisional application No. 61/630,601, filed on Dec. 15, 2011.

(51) Int. Cl.
*A63B 23/04* (2006.01)
*A63B 23/12* (2006.01)

(52) U.S. Cl.
CPC ..... *A63B 2208/0252* (2013.01); *A63B 2208/0257* (2013.01); *A63B 2209/02* (2013.01)

(56) References Cited

U.S. PATENT DOCUMENTS 3,707,285 A * 12/1972 Martin ..... A63B 1/00 472/16
3,958,803 A * 5/1976 Geisselbrecht ..... A63B 21/026 267/149
D243,103 S * 1/1977 Hale ..... D21/692
4,290,600 A * 9/1981 Kolbel ..... A63B 21/05 482/126
4,333,645 A * 6/1982 Wu ..... A63B 21/00043 482/112
4,376,533 A * 3/1983 Kolbel ..... A63B 21/00043 482/125
4,900,019 A * 2/1990 Shamir ..... A63B 21/023 482/123
5,031,906 A * 7/1991 Jang ..... A63B 21/0004 482/125
5,071,119 A * 12/1991 Johnson ..... A63B 21/0087 482/112
5,222,927 A * 6/1993 Chang ..... A63B 22/0005 482/126
5,279,530 A * 1/1994 Hess ..... A63B 21/0552 482/121
5,295,935 A * 3/1994 Wang ..... A63B 21/0552 482/123
5,480,367 A * 1/1996 Bergman ..... A63B 23/0488 482/122
5,499,958 A * 3/1996 Hess ..... A63B 21/0552 482/123
5,700,232 A * 12/1997 Clausen ..... A63B 21/0552 482/125
6,042,523 A * 3/2000 Graham ..... A63B 21/0552 482/121
6,071,217 A * 6/2000 Barnett ..... A63B 22/205 482/121
6,110,082 A * 8/2000 Tsai ..... A63B 21/0004 482/121
6,206,811 B1 * 3/2001 Lat ..... A63B 21/0004 482/121
6,488,614 B1 * 12/2002 Chang ..... A63B 21/0608 482/110
6,966,871 B2 * 11/2005 Parmater ..... A63B 21/023 482/129
7,288,052 B1 * 10/2007 Guillaume ..... A63B 21/055 482/121
D562,913 S * 2/2008 Grossman ..... D21/413
7,361,126 B2 * 4/2008 Bruce ..... A63B 21/0087 482/121
7,780,585 B1 * 8/2010 Rivas ..... A63B 21/0552 482/140
8,118,716 B2 * 2/2012 Grossman ..... A63B 25/08 482/77
8,430,800 B2 * 4/2013 Nolan ..... A63B 21/023 482/121
8,500,611 B2 * 8/2013 Hoffman ..... A63B 21/055 482/123
8,602,952 B1 * 12/2013 Cruz ..... A63B 21/04 482/121
2011/0294631 A1 * 12/2011 Wu ..... A63B 21/0552 482/129

* cited by examiner

TOTAL BODY EXERCISE SYSTEM AND METHOD

CROSS REFERENCE TO RELATED APPLICATIONS

This patent application claims the benefit of U.S. Provisional Patent Application No. 61/630,601 filed Dec. 15, 2011 and U.S. patent application Ser. No. 13/694,574 filed Dec. 13, 2012, the disclosure of which is incorporated by reference in its entirety.

STATEMENT OF FEDERALLY SPONSORED RESEARCH OR DEVELOPMENT

Not applicable.

NAMES OF PARTIES TO A JOINT RESEARCH AGREEMENT

Not applicable.

REFERENCE TO A COMPACT DISK APPENDIX

Not applicable.

BACKGROUND OF INVENTION

1. Field of the Invention

This invention relates to an apparatus and method for performing physical exercise, and particularly to a system that is portable and improves body strength in an efficient, functional, and safe way.

2. Description of the Related Art

Exercise machines that are used only in certain limited body positions, isolate muscle groups, move the spine from a flexed to an extended position, are difficult or complicated to use, are difficult and expensive to manufacture, and are bulky and not portable, are known in the art.

The present invention is a total body exercise system that provides many advantages over the prior art. Performing exercises using the present invention allows the extremities to move through a full range of motion while the operator is standing, lying prone, lying supine, or lying on one side, and also exercises the extremities in many combinations, including a combination of legs and arms at the same time, arms only, legs only, one arm and one leg on the same side of the body, or one leg and one arm on opposite sides of the body, thereby maximizing the strengthening and conditioning effects achieved by the operator. Further, the present invention strengthens and conditions the muscles in a functional way, whereby muscles are exercised as functional groups, in contrast to prior art exercise devices that isolate muscle groups. In addition, the present invention strengthens and conditions the trunk and core, including the neck, chest, abdominal, and back muscles, while simultaneously strengthening and conditioning the muscles of the extremities, thereby providing a balance of strength and conditioning between different muscle groups, which maximizes total body strength, conditioning, and flexibility, and avoids and prevents injury. In addition, in contrast to prior art exercise machines that move the spine from a flexed to an extended position, the present invention strengthens and conditions the trunk and core and the extremities while maintaining the spine in its naturally safe lordotic curved position in multiple positions of use by the operator, including standing, lying prone, lying supine, and lying on one side, thereby avoiding and preventing injury. Finally, the present invention provides a total body exercise system that is light, compact, and portable, which is advantageous when storing the exercise system, shipping it, or moving or traveling with it.

SUMMARY OF INVENTION

The present invention provides an apparatus and method for performing physical exercise that is novel and useful in providing a portable system that improves strength and conditioning of the operator in a safe, efficient, and functional way, in which the spine is kept in its safe and natural position and opposing muscle groups are strengthened and conditioned to similar levels, which is ideal for efficient and proper strengthening and conditioning and avoidance of injury.

According to one embodiment of the present invention, an exercise system comprises an elongated member, a hollow member, and at least one resistance band. The elongated member may be positioned within the hollow member, and the elongated member and the hollow member may be slidably moveable relative to each other. At least one resistance band may be secured at one securing location on the elongated member and at one securing location on the hollow member. Movement of the hollow member and the elongated member relative to each other by the operator stretches a resistance band, which creates resistance to the movement, thereby exercising, strengthening, and conditioning the operator.

In another embodiment, the exercise system may further include a pair of handles that that are attached to the hollow member and extending outwardly from the hollow member. The handles are adapted to receive force, which if large enough to overcome the resistance created by a resistance band, will slidably move the hollow member and the elongated member relative to each other. Force may be applied to one or both of the handles by one or both hands of the operator.

In another embodiment, the exercise system may further include a foot board system with a foot board tube that is attached to the elongated member and extending outwardly from the elongated member. The foot board system is adapted to receive force, which if large enough to overcome the resistance created by a resistance band, will slidably move the hollow member and the elongated member relative to each other. Force may be applied to the foot board system by one or both feet of the operator.

In another embodiment, force may be applied to one or both of the handles by one or both hands of the operator in one direction, and at the same time force may be applied to the foot board system by one or both feet of the operator in the opposite direction.

In another embodiment, the elongated member includes two ends, a foot board end where a foot board tube of the foot board system may be attached, and a head end where one or more band anchors may be attached. The hollow member includes two ends, a handle end where the handles may be attached, and a feet end where one or more band anchors may be attached. The elongated member is positioned within the hollow member in such a way that the handle end of the hollow member is generally situated at or toward the opposite end of the exercise system from the foot board end of the elongated member. The foot board end of the elongated member comprises the distal end of the exercise system, and the head end of the elongated member comprises the proximal end of the exercise system. The securing locations on the elongated tube to which a resistance band may be secured include the foot board tube, one or more band anchors attached to the foot board tube, and one or more band anchors attached to the head end of the elongated member. The securing locations on the hollow member to which a resistance band may be secured include one or more band anchors attached to the feet end of the hollow member, and one or both handles attached to the handle end of the hollow member.

In another embodiment, the elongated member may be substantially longer than the hollow member, by at least about twice the length of the hollow member, and the distance the hollow member and the elongated member may be slidably moved relative to each other may be at least about the length of the elongated member.

In another embodiment, the outside diameter or dimensions of the elongated member may be slightly smaller than the inside diameter or dimensions of the hollow member, by at least enough distance to allow the elongated member and the hollow member to be slidably moved relative to each other.

BRIEF DESCRIPTION OF DRAWINGS

A more complete appreciation of the present invention is provided by reference to the following detailed description of the appended drawings and figures. The following description in conjunction with the appended figures enables a person having skill in the art to recognize the numerous advantages and features of the present invention by understanding the various disclosed embodiments. It should be understood, however, the invention is not limited to the precise arrangements in the instrumentality shown. The following figures are utilized to best illustrate these features.

DETAILED DESCRIPTION OF INVENTION

Figure 1:
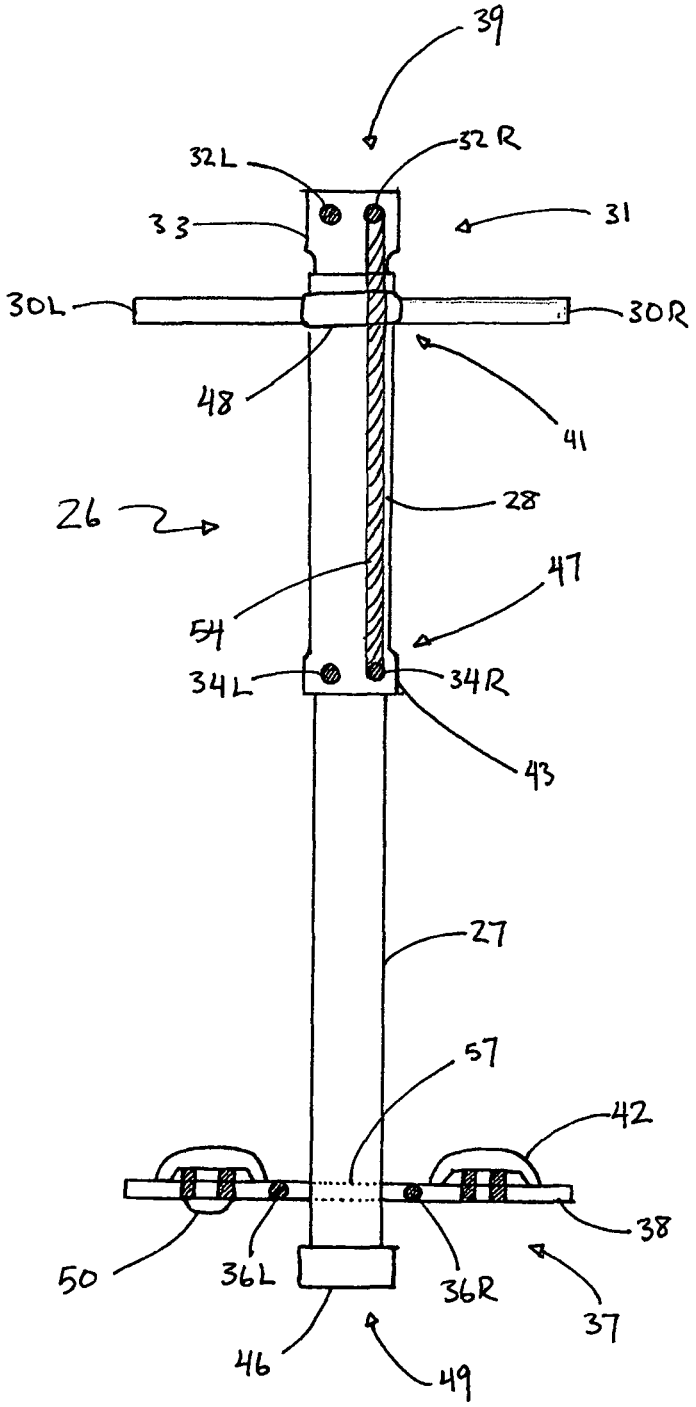
FIG. 1 provides a front elevation view of a total body exercise system according to one aspect of the invention.
Figure 2:
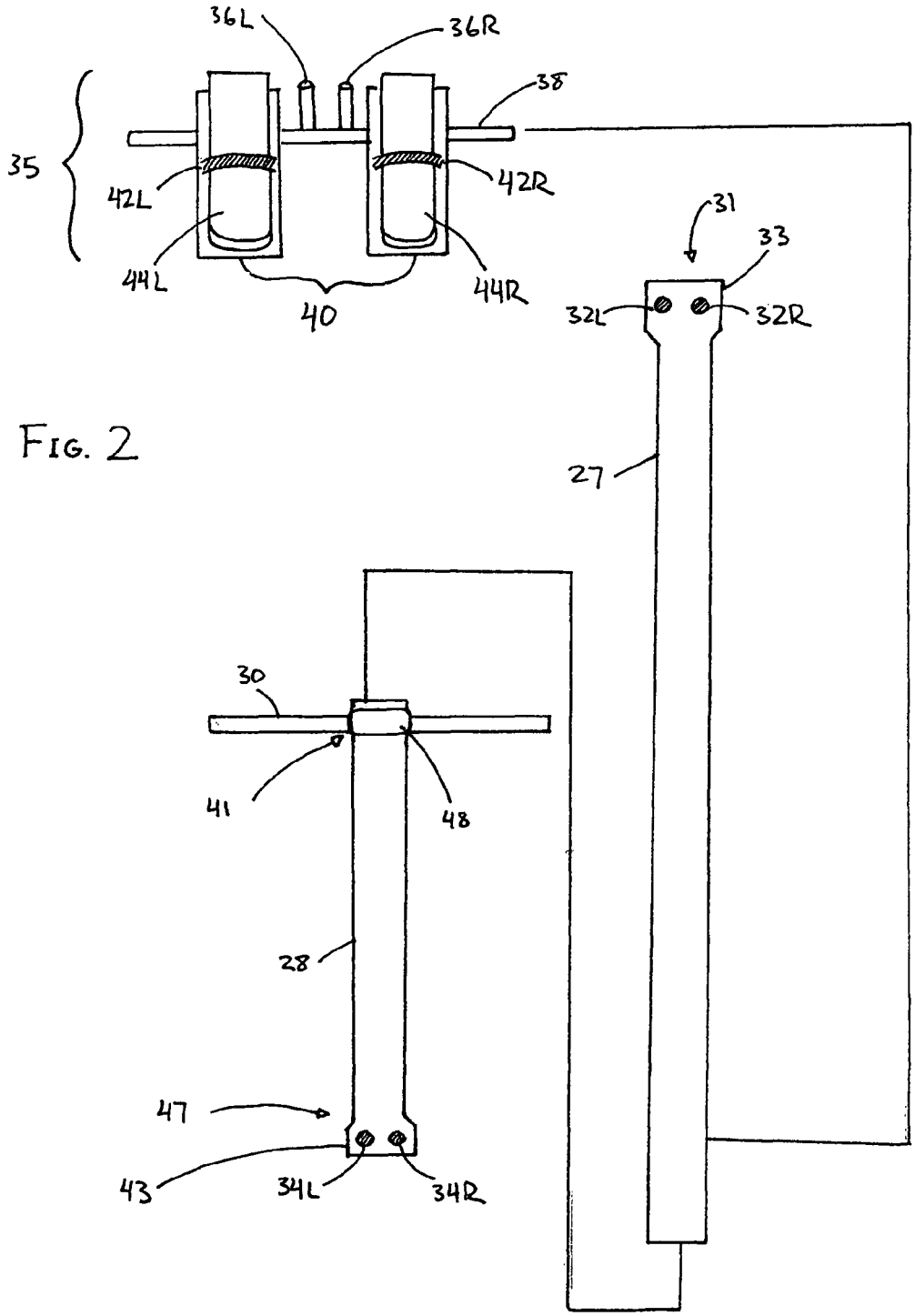
FIG. 2 provides an exploded view of a total body exercise system according to one aspect of the invention.

The following discussion is presented to enable a person skilled in the art to make and use the present invention. References herein to any of the hands making any contact with the apparatus shall include but are not limited to one or both hands being pronated relative to the handle 40, one or both hands being supinated relative to the handle 40, and/or any combination thereof. Except where expressly stated otherwise, references herein to any of the extremities making any contact with the apparatus shall include but are not limited one or both hands making such contact, one or both feet making such contact, and/or any combination thereof. References herein to securing the distal end 49 shall include but are not limited to placing a foot in contact with a part of the foot board system 35 and/or placing the distal end 49 in contact with a wall, floor, or other solid object. The general principles described herein may be applied to embodiments and applications other than those specifically detailed below without departing from the spirit and scope of the present invention. Therefore, the present invention is not intended to be limited to the embodiments expressly shown, but is to be accorded the widest possible scope of invention consistent with the principles and features disclosed herein.

Referring to FIGS. 1-3*b*, a preferred embodiment of a total body exercise system 26 of the present invention is shown. The elongated member 27 includes two ends, a foot board end 37 where a foot board tube 38 is attached, and a head end 31 where one or more band anchors 32 may be attached. The hollow member 28 includes two ends, a handle end 41 where the handles 30 may be attached, and a feet end 47 where one or more band anchors 34 may be attached. The elongated member 27 is positioned within the hollow member 28 in such a way that the handle end 41 of the hollow member 28 is generally situated at or toward the opposite end of the exercise system 26 from the foot board end 37 of the elongated member 27. The foot board end 37 of the elongated member 27 comprises the distal end 49 of the exercise system 26, and the head end 31 of the elongated member 27 comprises the proximal end 39 of the exercise system 26. The outside diameter or dimension of the elongated member 27 is slightly smaller than the inside diameter or dimension of the hollow member 28, by at least enough distance to allow the elongated member 27 and the hollow member 28 to be slidably moved relative to each other. The elongated member 27 is substantially longer than the hollow member 28, by at least about twice the length of the hollow member 28, and the distance the hollow member 28 and the elongated member 27 may be slidably moved relative to each other is at least about the length of the hollow member 28. The elongated member 27 is preferably constructed in a single piece. In other embodiments, elongated member 27 is constructed in two or more sections which are assembled into a single piece for use of the exercise system 26 by the operator, and may be disassembled when the exercise system 26 is not in use. In one embodiment, the sections are assembled by pressing one end of one section into one end of another section. In another embodiment, the sections are assembled by inserting and tightening one end of one section threaded with male threads into one end of another section threaded with female threads. The sections may be assembled using other methods as known in the art with departing from the spirit and scope of the present invention. The elongated member 27 and/or the hollow member 28 are preferably made of fiberglass, but also may be made of carbon fiber, metal, plastic, wood, or any other material that is sufficiently strong to withstand the forces of use of the exercise system 26 by the operator without breaking or excessively bending, meaning bending to such a degree that slidable movement of the elongated member 27 relative to the hollow member 28 becomes difficult or impossible when the exercise system 26 is in use by the operator, without departing from the spirit and scope of the present invention. The elongated member 27 and the hollow member 28 are shown as tubular in shape, meaning circular in cross section, but may also be provided in shapes other than tubular, such as oval, square, rectangular, or triangular in cross section, or other geometric shapes, without departing from the spirit and scope of the present invention.

The head end 31 of elongated member 27 is flanged, in which the outside diameter or dimension of the head end 31 of elongated member 27 is slightly larger than the outside diameter or dimension of the remainder of the elongated member 27, and the outside diameter or dimension of the flanged portion 33 of the elongated member 27 is about equal to the outside diameter or dimension of the handle end 41 of hollow member 28, such that when the head end 31 of the elongated member 27 slidably moves toward the handle end 41 of hollow member 28, contact between the flanged portion 33 of the elongated member 27 and the handle end 41 of the hollow member 28 prevents any further such slidable movement in that direction. The feet end 47 of hollow member 28 is also flanged in a similar manner to the flanged portion 33 of the elongated member 27, and the flanged portion 43 of hollow member 28 is slightly larger than the outside diameter or dimension of the remainder of the hollow member 28, by about the same proportion as the increase in diameter or dimension of the flanged portion 33 of the elongated member 27 relative to the diameter or dimension of the remainder of the elongated member 27, and the extra thickness of the hollow member 28 at the feet end 47 may provide increased depth in which to secure band anchors 34L and 34R. The dimensions of flanged portion 33 of elongated member 27 and/or the flanged portion 43 of hollow member 28 may be modified, or flanged portion 33 and/or the flanged portion 43 may be omitted, without departing from the spirit and scope of the present invention.

Referring to FIGS. 1-3*b*, certain components are preferably affixed to the elongated member 27, the hollow member 28, or other components. Components may be affixed by welding, gluing, or other methods as known in the art which do not allow for the removal of the component. Other components are preferably removably attached to the elongated member 27, the hollow member 28, or other components. Components may be removably attached by screws, nuts and bolts, clamps, pressing on, inserting and tightening one component threaded with male threads into another component threaded with female threads, or by other methods which allow for the removal of the component. One or more of the components that are described as removably attached may instead be affixed, and one or more of the components that are described as affixed may be removably attached, without departing from the spirit and scope of the present invention. Components may be made of fiberglass, carbon fiber, metal, plastic, wood, natural or synthetic fibers, or any other materials that are sufficiently strong to withstand the forces of use of the exercise system 26 by the operator without breaking or excessively bending, meaning bending to such a degree that slidable movement of the elongated member 27 relative to the hollow member 28 becomes difficult or impossible when the exercise system 26 is in use by the operator.

Handles 30L and 30R are affixed to a handle clamp 48 which is affixed to the handle end 41 of hollow member 28, preferably by glue, welding, or other methods as known in the art. In another embodiment, handles 30L and 30R are affixed to handle clamp 48, which is removably attached to handle end 41 of hollow member 28 by clamping, bolting, or other methods known in the art. Handle clamp 48 may further comprise two C-shaped sections joined together into the shape of a ring by gluing, welding, by bolts on each side, or by a hinge on one side and a bolt on the other side. The handles 30L and 30R receive force from the hands of the operator when the exercise system 26 is in use. Handles 30L and 30R also provide securing locations for at least one resistance band 54. Resistance band 54 is preferably constructed of natural or synthetic rubber, and resembles a large common rubber band. In other embodiments, resistance band 54 is constructed of natural or synthetic rubber, and is comprised of a single strap with loops at each of its two ends of sufficient diameter to allow the resistance band 54 to be secured to securing locations such as handles 30L or 30R, band anchors 32L, 32R, 34L, 34R, 36L, or 36R, or foot, board tube 38. Resistance bands 54 may be constructed of different thicknesses and/or lengths to provide different levels of resistance. Band anchors 32L, 32R, 34L, 34R, 36L, and 36R are preferably rods which are affixed to elongated member 27 or hollow member 28 by glue, welding, or other methods as known in the art. In other embodiments, band anchors 32L, 32R, 34L, 34R, 36L, and 36R are hooks, studs, rings, bolts, or screws, or other similar members that are suitable for providing a securing location for at least one resistance band 54. Affixed to the feet end 47 of hollow member 28 are band anchors 34L and 34R which provide securing locations for at least one resistance band 54. Affixed to the head end 31 of the elongated member 27 are band anchors 32L and 32R which provide securing locations for at least one resistance band 54.

Foot board tube 38 is inserted into foot board tube hole 57 drilled into foot board end 37 of elongated member 27. The diameter of foot board hole 57 is slightly larger than the outside diameter of foot board tube 38, such that when foot board tube 38 is positioned in foot board tube hole 57, foot board tube 38 may freely rotate about its long axis, such that when exercise system 26 is in use the angle of the feet of the operator 52, referring to the flexion or extension of the ankles of the operator 52 relative to the long axis of elongated member 27, may be changed by the body movement of the operator 52. Affixed to foot board tube 38 are band anchors 36L and 36R which provide securing locations for at least one resistance band 54. Foot board tube 38 also provides securing locations for at least one resistance band 54. Foot boards 40L and 40R are removably attached to foot board tube 38 preferably by inserting and tightening a plurality of footboard bolts 50 through a plurality of holes drilled in foot board tube 38 and a plurality of holes drilled in foot boards 40L and 40R. The foot board system 35 comprises foot holders 44L and 44R and foot straps 42L and 42R. Foot straps 42L and 42R are removably attached to foot holders 44L and 44R, respectively, preferably by inserting and threading screws through foot straps 42L and 42R and into foot holders 44L and 44R. Foot holders 44L and 44R are removably attached to foot boards 40L and 40R, respectively, preferably by inserting and threading screws through foot holders 44L and 44R and into foot boards 40L and 40R, respectively. The length of the foot straps 42L and 42R may be adjusted by buckles, hook-and-loop fasteners, or other methods known in the art, for the use of exercise system 26 by different operators 52 with different sizes of feet. In addition, the length of the foot holders 44L and 44R may be adjusted by sliding theme up or down on the foot boards 40L and 40R, respectively, and removably attaching them to the foot boards 40L and 40R, respectively, for use by different operators 52 with different sizes of feet. In another embodiment, instead of foot straps 42L and 42R and foot holders 44L and 44R, the foot board system 35 may comprise a pair of cover foot stretchers and flexfoots (Concept 2, Morrisville, Vt.) each of which may be removably attached to foot boards 40L and 40R by inserting and tightening a plurality of foot board bolts 50 through holes cut or drilled through the cover foot stretchers and into foot boards 40L and 40R. In another embodiment, instead of foot straps 42L and 42R and foot holders 44L and 44R, the foot board system may comprise a pair of shoes each of which may be removably attached to foot boards 40L and 40R by inserting and tightening a plurality of foot board bolts 50 through holes cut or drilled through the soles of the shoes and into foot boards 40L and 40R. End cap 46 is removably attached to the tip of the foot board end 37 of elongated member 27. End cap 46 may be made of a durable and skid-resistant material such that it is suitable to be placed on a floor and/or against a wall so as to maintain the position of the tip of the foot board end 37 of elongated member 27 in place during use of the exercise system 26.

Figure 3:
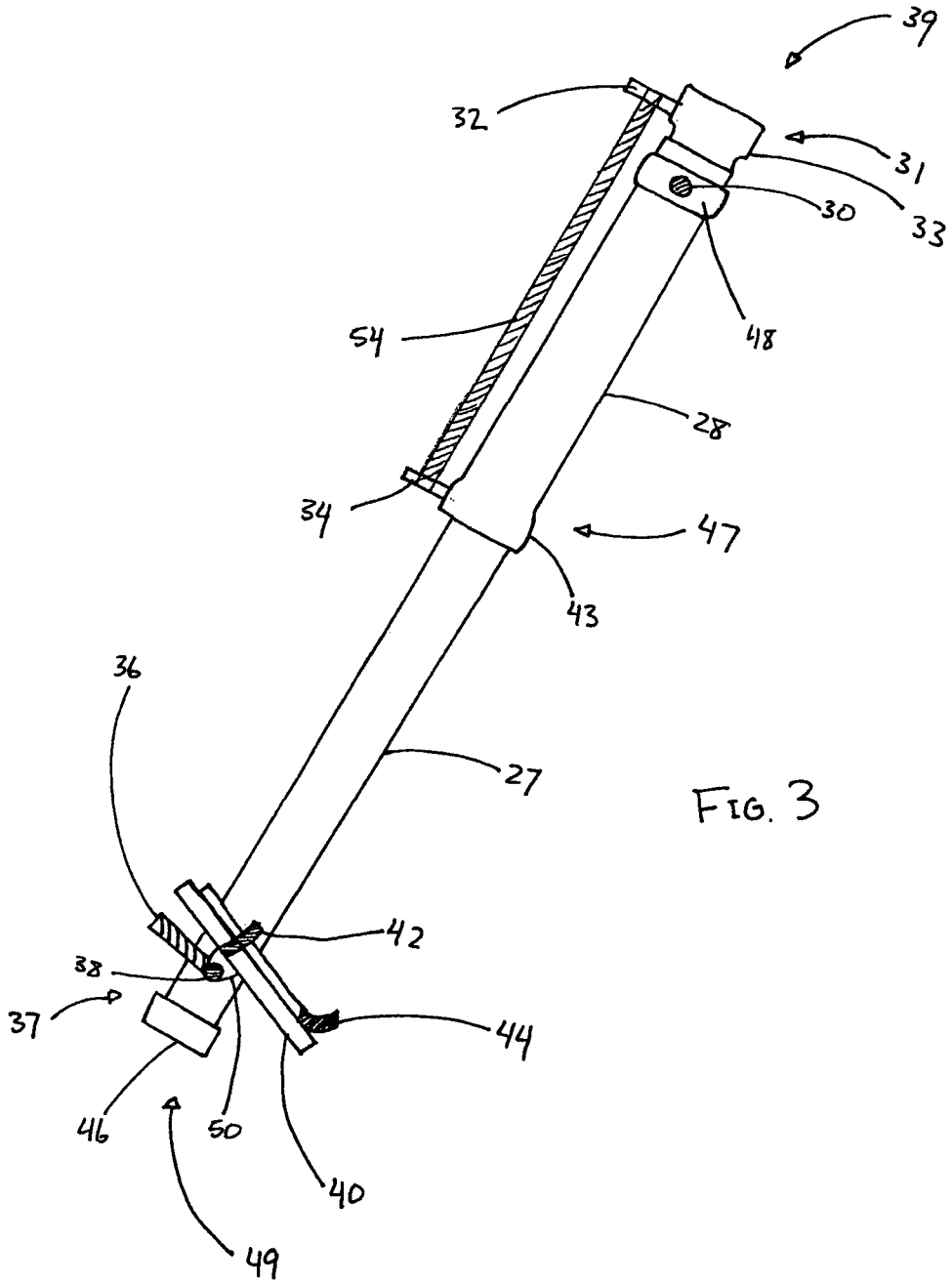
FIG. 3 provides a side elevation view of a total body exercise system according to one aspect of the invention.
Figure 3A:
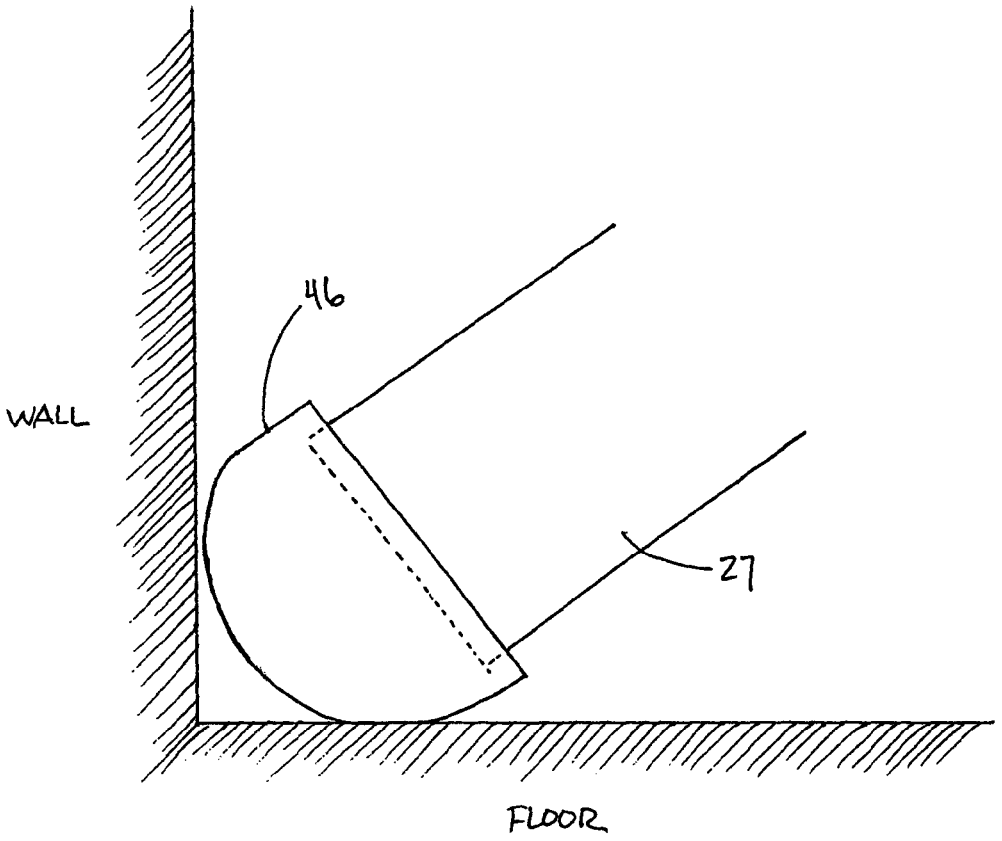
FIG. 3*a* provides a partial view of a total body exercise system according to one aspect of the invention.
Figure 3B:
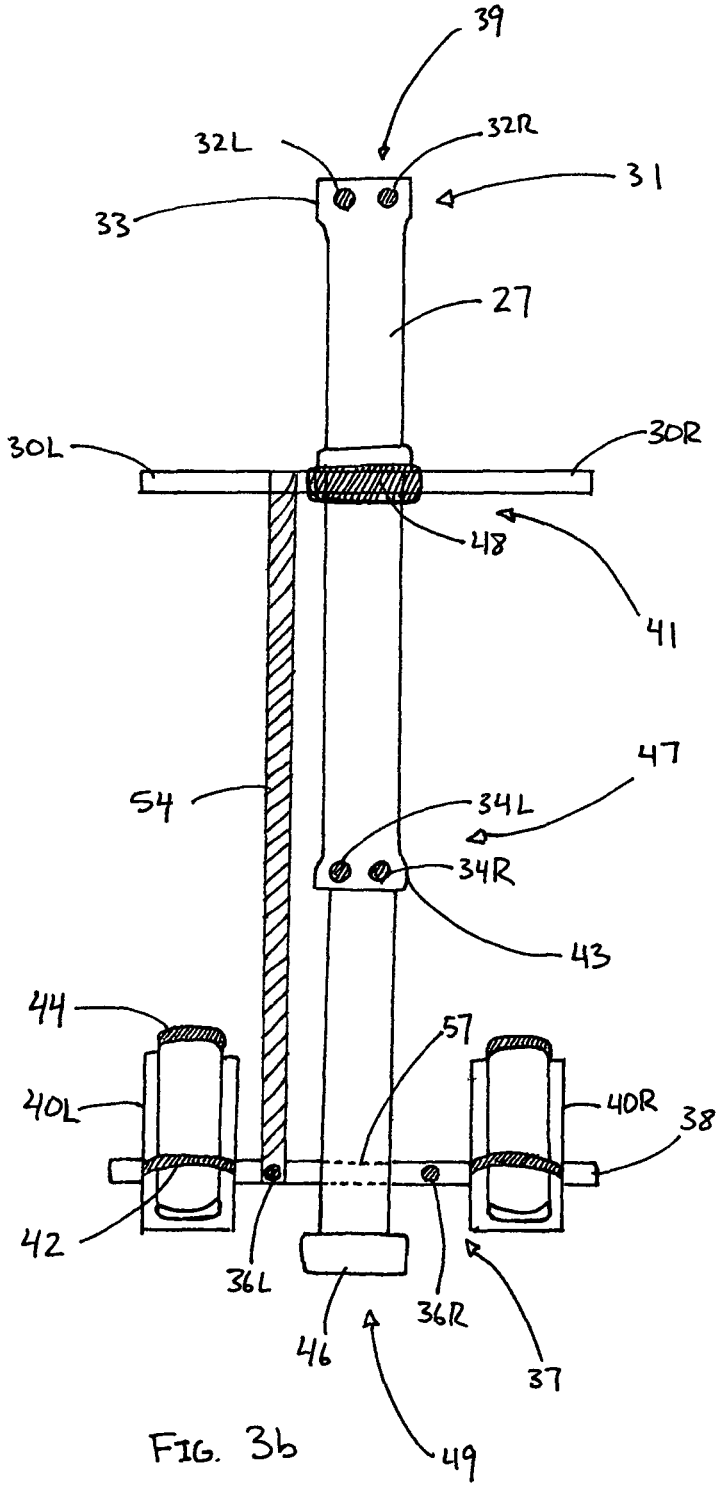
FIG. 3*b* provides a front elevation view of a total body exercise system according to one aspect of the invention.

At least one resistance band 54 is secured to two securing locations, one securing location on the elongated member 27, and one securing location on the hollow member 28. Securing a resistance band 54 to securing locations such as handles 30L or 30R, band anchors 32L, 32R, 34L, 34R, 36L, or 36R, or foot board tube 38 refers to a resistance band 54 being placed between two securing locations, one end of the resistance band 54 is looped around one securing location, and the other end of the resistance band 54 is looped around the other securing location, as illustrated in FIGS. 1, 3, and 3*b*. The operator 52 may apply force to one or both of the handles 30 by one or both hands of the operator 52 in one direction, and at the same time apply force to the foot board system 35 by one or both feet of the operator 52 in the opposite direction, which causes movement of the hollow member 28 and the elongated member 27 relative to each other. The operator 52 also may position the tip of the foot board end 37 of the elongated member 27 on a floor and/or against a wall with the end cap 46 in contact with the wall and or floor so as to maintain the position of the tip of the foot board end 37 of elongated member 27 in place, as illustrated in FIG. 3*a*, and apply force to one or both of the handles 30L or 30R by one or both hands of the operator 52 in the direction of the tip of the foot board end 37 of the elongated member 27. Movement of the hollow member 28 relative to the elongated member 27 caused by the application of force by the operator 52 stretches a resistance band 54, which creates resistance to the movement, thereby exercising, strengthening, and conditioning the operator 52.

Referring to FIGS. 1 and 3, the first configuration of the exercise system 26 is shown. In the first configuration, a resistance band 54 is secured to band anchors 32R and 34R. Also in the first configuration, a resistance band 54 may be secured to band anchors 32L and 34L, instead of or in addition to a resistance band 54 is secured to band anchors 32R and 34R. Also in the first configuration, more than one resistance band 54 may be secured to band anchors 32R and 34 R, and/or band anchors 32L and 34L. To use the exercise system 26 in the first configuration, the operator applies force to the handles 30L and 30R by both hands in the direction of the distal end 49 of the exercise system 26, and at the same time applies force to the foot board system 35 by both feet in the direction of the proximal end 39 of the exercise system 26, which causes movement of the hollow member 28 and the elongated member 27 relative to each other. Movement of the hollow member 28 and the elongated member 27 relative to each other caused by the application of force by the operator stretches the resistance band 54, which creates resistance to the movement, thereby exercising, strengthening, and conditioning the operator.

Referring to FIGS. 1, 3, and 3*a*, also to use the exercise system 26 in the first configuration, the operator positions the tip of the foot board end 37 of elongated member 27 on a floor and/or against a wall, with the end cap 46 in contact with the wall and/or floor so as to maintain the position of the tip of the foot board end 37 of elongated member 27 in place, as illustrated in FIG. 3*a*. The operator 52 then applies force to one or both of the handles 30L or 30R by one or both hands of the operator in the direction of the tip of the foot board end 37 of the elongated member 27. Movement of the hollow member 28 relative to the elongated member 27 caused by the application of force by the operator stretches a resistance band 54, which creates resistance to the movement, thereby exercising, strengthening, and conditioning the operator.

Referring to FIG. 3*b*, the second configuration of the exercise system 26 is shown. In the second configuration, a resistance band 54 is secured to band anchor 36L and to handle 30L. Also in the second configuration, a resistance band 54 may be secured to band anchor 36R and handle 30R, instead of or in addition to a resistance band 54 is secured to band anchor 36L and handle 30L. Also in the first configuration, more than one resistance band 54 may be secured to band anchor 36L and handle 30L, and/or band anchor 36R and handle 30R. Also in the first configuration, one end of a resistance band 54 may be secured to foot board tube 38 instead of band anchors 36L and/or 36R. The operator applies force to the handles 30L and 30R by both hands in the direction of the proximal end 39 of the exercise system 26, and at the same time applies force to the foot board system 35 by both feet in the direction of the distal end 49 of the exercise system 26, which causes movement of the hollow member 28 and the elongated member 27 relative to each other. Movement of the hollow member 28 and the elongated member 27 relative to each other caused by the application of force by the operator stretches the resistance band 54, which creates resistance to the movement, thereby exercising, strengthening, and conditioning the operator.

Method of Use

The exercise system 26 of the present inventions is used for exercising the muscles of the extremities and the trunk and core, including the neck, chest, abdomen, and back. Methods of using the exercise system 26, or exercises, are performed standing, lying prone, lying supine, and lying on one side. Exercises described or illustrated using one arm of a particular side of the body are also performed using the arm of the opposite side of the body. Exercises described or illustrated using one leg of a particular side of the body are also performed using the leg of the opposite side of the body. Exercises are performed one or more times at the option of the operator 52, and in any order chosen by the operator 52, for strengthening and conditioning. Exercises using the exercise system 26 in the first configuration are shown in FIGS. 4-10 and 15-25. Exercises using the exercise system 26 in the second configuration are shown in FIGS. 11-14.

Exercises are performed by the operator 52 lying supine and using the exercise system 26 in the first configuration. At least one resistance band 54 is secured to one or more band anchors 32L and/or 32R and to band anchors 34L and/or 34R. The operator then performs one or more of the following exercises as shown in FIGS. 4-10 and 15-25.

Figure 4A:
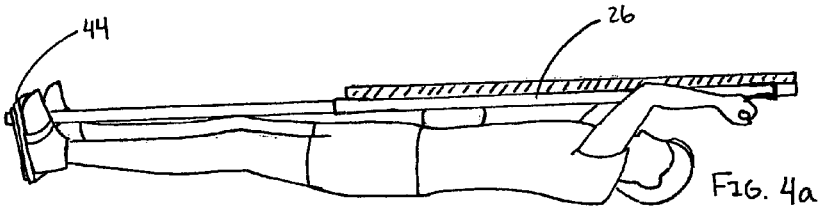
FIGS. 4*a*-37*b* provide perspective views of a total body exercise system in use according to one aspect of the invention.
Figure 4B:
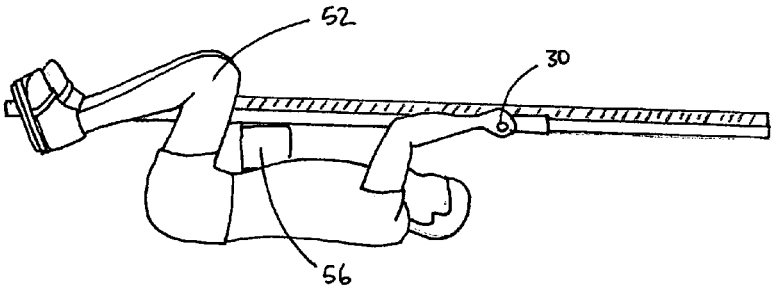

As shown in FIG. 4*a*, both feet of the operator 52 are placed into foot holders 44L and 44R and secured by tightening foot straps 42L and 42R. The operator 52 then places pad 56 on their abdomen to raise the exercise system 26 off their abdomen. Pad 56 may be constructed of cork, rubber, and/or any other natural or synthetic material or cloth that is strong and stiff enough to raise the exercise system 26 off the abdomen and soft enough to cushion the contact of the exercise system 26 with the abdomen while exercises are being performed. The operator straightens the legs, raises both hands over the head, and grasps handles 30L and 30R. As shown in FIG. 4*b*, operator 52 simultaneously pulls foot boards 40 toward the proximal end 39 using the legs while holding handles 30L and 30R in place over the head using the arms. The exercise shown in FIG. 4 is also performed with only one foot of the operator 52 secured to one of the foot holders 44L or 44R. The exercise shown in FIG. 4 may also be performed without pad 56.

Figure 5A:
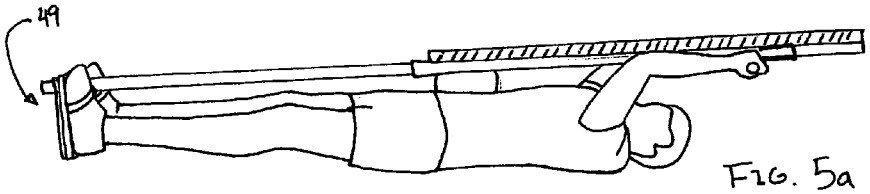
Figure 5B:
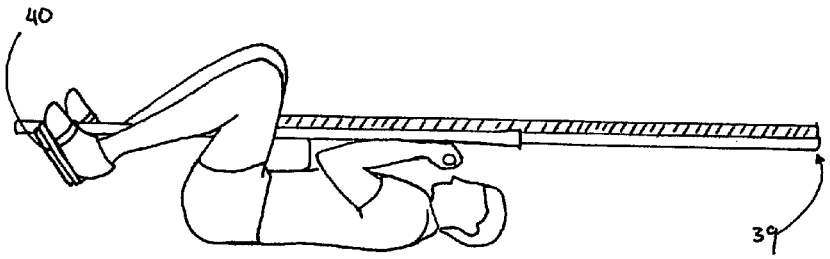

As shown in FIG. 5*a*, both feet of the operator 52 are placed into the foot holders 44L and 44R and secured by tightening foot straps 42L and 42R. The operator 52 then places pad 56 on their abdomen to raise the exercise system 26 off their abdomen. The operator straightens the legs, raises both hands over the head, and grasps handles 30L and 30R. As shown in FIG. 5*b*, operator 52 simultaneously pulls foot boards 40 toward the proximal end 39 using the legs and pulls the handles 30L and 30R toward the distal end 49 using the arms. The exercise shown in FIG. 5 may also be performed without pad 56.

Figure 6A:
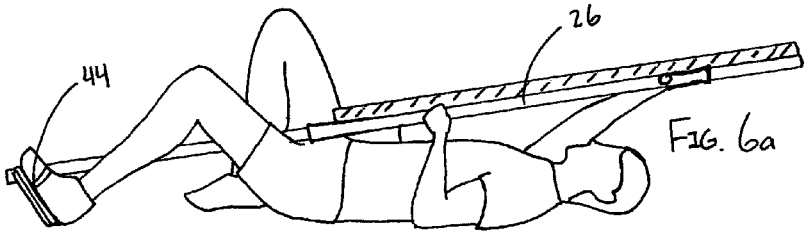
Figure 6B:
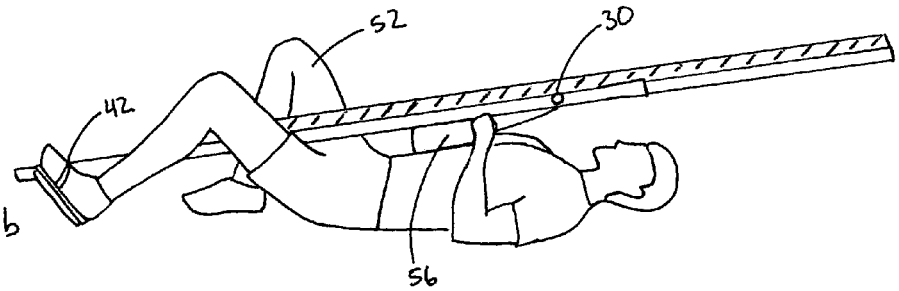

As shown in FIG. 6*a*, the left foot of the operator 52 is placed into foot holder 44L and secured by tightening foot strap 42L. The operator 52 then places pad 56 on their abdomen to raise the exercise system 26 off their abdomen. The operator bends the left leg to about 80-100 degrees of flexion, preferably about 90 degree of flexion, raises the right hand over the head, and grasps handle 30R. As shown in FIG. 6*b*, operator 52 simultaneously pulls handle 30R toward the distal end 49 using the right arm and holds foot boards 40 in place using the left leg. The exercise shown in FIG. 6 is also performed with the opposite extremities, such that the right foot of the operator 52 is placed into foot holder 44R and secured by tightening foot strap 42R, the operator raises the left hand over the head, grasps handle 30L, and simultaneously pulls handle 30L toward the distal end 49 using the left arm while holding foot boards 40 in place using the right leg. The exercise shown in FIG. 6 may also be performed without pad 56.

Figure 7A:
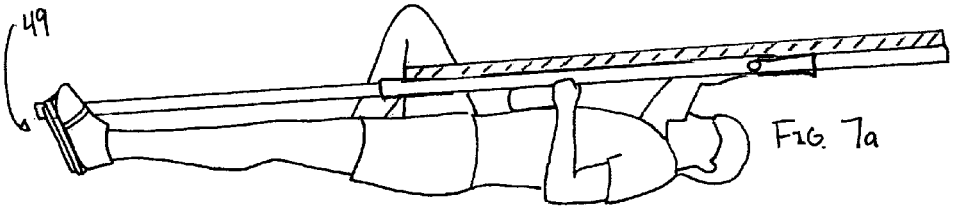
Figure 7B:
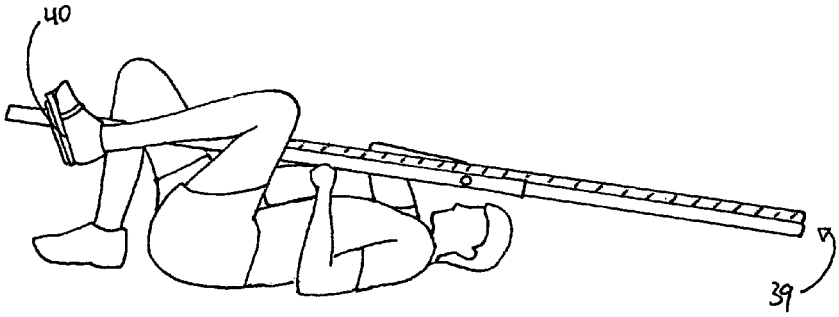

As shown in FIG. 7*a*, the left foot of the operator 52 is placed into foot holder 44L and secured by tightening foot strap 42L. The operator 52 then places pad 56 on their abdomen to raise the exercise system 26 off their abdomen. The operator straightens the left leg, raises the right hand over the head, and grasps handle 30R. As shown in FIG. 7*b*, operator 52 simultaneously pulls foot boards 40 toward the proximal end 39 using the left leg and pulls handle 30R toward the distal end 49 using the right arm. The exercise shown in FIG. 7 is also performed with the opposite extremities, such that the right foot of the operator 52 is placed into foot holder 44R and secured by tightening foot strap 42R, the operator raises the left hand over the head, grasps handle 30L, and simultaneously pulls foot boards 40 toward the proximal end 39 using the right leg and pulls handle 30L toward the distal end 49 using the left arm. The exercise shown in FIG. 7 may also be performed without pad 56.

Figure 8A:
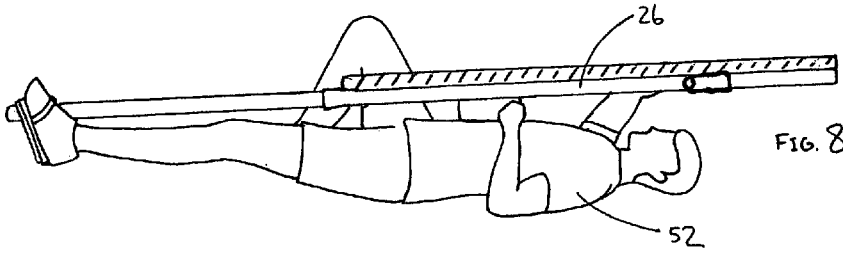
Figure 8B:
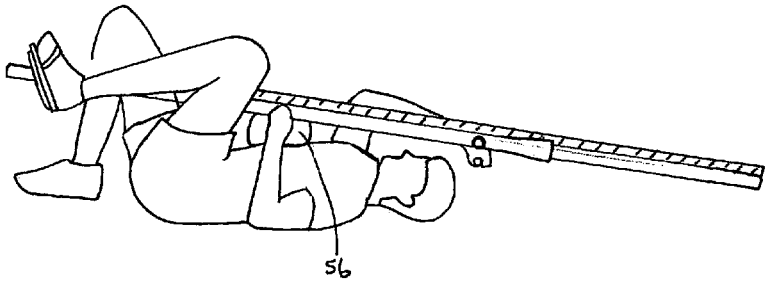

As shown in FIG. 8*a*, the left foot of the operator 52 is placed into foot holder 44L and secured by tightening foot strap 42L. The operator 52 then places pad 56 on their abdomen to raise the exercise system 26 off their abdomen. The operator straightens the left leg, raises the right hand over the head, and grasps handle 30R. As shown in FIG. 8*b*, operator 52 simultaneously pulls foot boards 40 toward the proximal end 39 using the left leg and holds handle 30R in place using the right arm. The exercise shown in FIG. 7 is also performed with the opposite extremities, such that the right foot of the operator 52 is placed into foot holder 44R and secured by tightening foot strap 42R, the operator raises the left hand over the head, grasps handle 30L, and simultaneously pulls foot boards 40 toward the proximal end 39 using the right leg and holds handle 30L in place using the left arm and. The exercise shown in FIG. 8 may also be performed without pad 56.

Figure 10A:
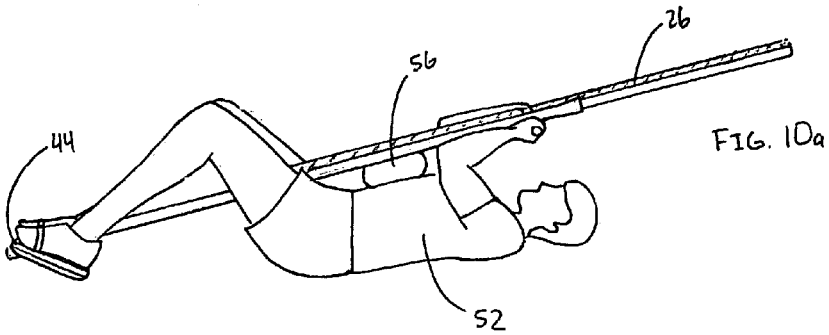
Figure 10B:
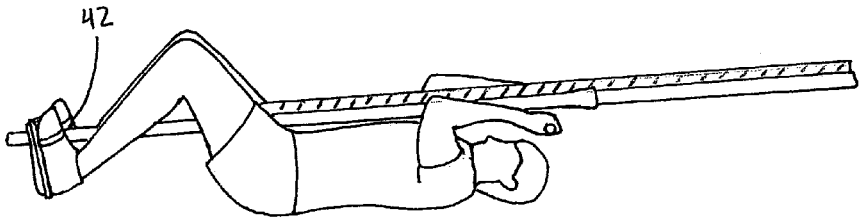

As shown in FIG. 10*a*, both feet of the operator 52 are placed into foot holders 44L and 44R and secured by tightening foot straps 42L and 42R. The operator 52 then places pad 56 on their abdomen to raise the exercise system 26 off their abdomen. The operator bends both legs to about 80-100 degrees of flexion, preferably about 90 degree of flexion, raises both hands over the head, and grasps handles 30L and 30R. As shown in FIG. 10*b*, operator 52 simultaneously pulls the foot boards 40 toward the proximal end 39 by flexing the feet at the ankles but not otherwise moving the legs while holding handles 30L and 30R in place over the head using the arms. The exercise shown in FIG. 10 is also performed with only one foot of the operator 52 secured to one of the foot holders 44L or 44R. The exercise shown in FIG. 10 may also be performed without pad 56.

Figure 15A:
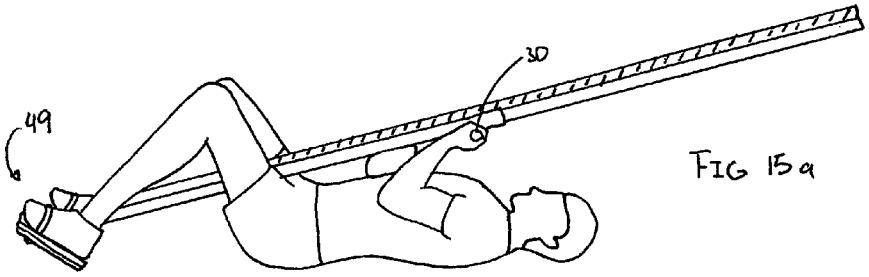
Figure 15B:
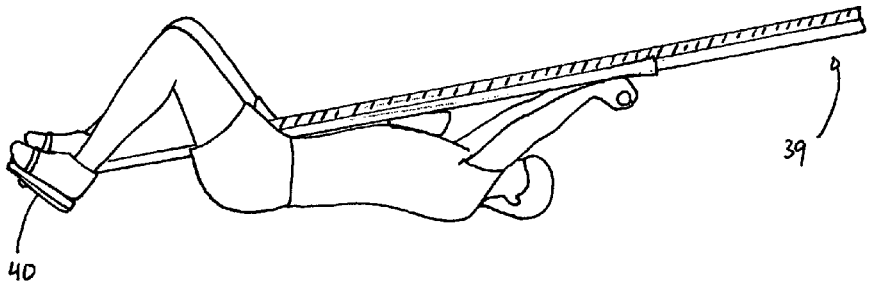

As shown in FIG. 15*a*, both feet of the operator 52 are placed into foot holders 44L and 44R and secured by tightening foot straps 42L and 42R. The operator 52 presses the foot boards 40 to the floor so that the distal end 49 is in contact with the floor, grasps handles 30L and 30R, and positions the hands and handles 30L and 30R to about the level of the chest. As shown in FIG. 15*b*, operator 52 simultaneously pulls the handles 30L and 30R toward the distal end 49 using the arms and holds the foot boards 40 in place and in contact with the floor using the legs. The exercise shown in FIG. 15 is also performed with only one arm of the operator 52 grasping one of the handles 30L or 30R and pulling that handle 30L or 30R toward the distal end 49.

Figure 9A:
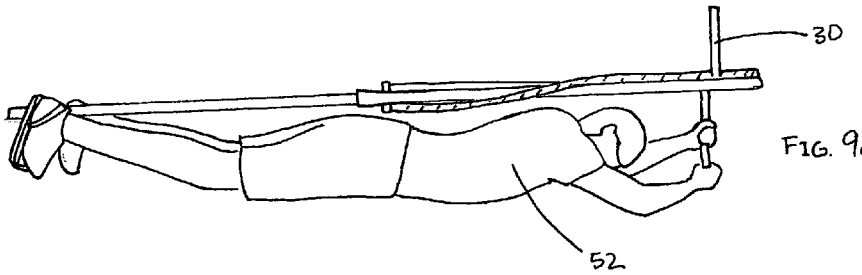
Figure 9B:
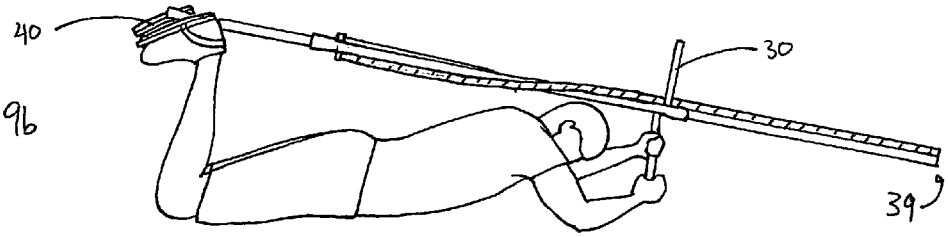

Exercises are also performed by the operator 52 lying prone and using the exercise system 26 in the first configuration. At least one resistance band 54 is secured to one or more band anchors 32L and/or 32R and to band anchors 34L and/or 34R. The operator then performs one or more of the following exercise as shown in FIG. 9. As shown in FIG. 9*a*, both feet of the operator 52 are placed into foot holders 44L and 44R and secured by tightening foot straps 42L and 42R. The operator straightens the legs, raises both hands over the head, and grasps one of the handles 30L or 30R. As shown in FIG. 9*b*, operator 52 simultaneously pulls the foot boards 40L and 40R toward the proximal end 39 using the legs while holding handle 30L or 30R in place over the head using the arms. The exercise shown in FIG. 9 is also performed with only one foot of the operator 52 secured to one of the foot holders 44L or 44R.

Exercises also are performed by the operator 52 lying supine and using the exercise system 26 in the second configuration. At least one resistance band 54 is secured to one or more handles 30L and/or 30R and to band anchors 36L and/or 36R. In the alternative, at least one resistance band 54 is secured to one or more handles 30L and/or 30R and to foot board tube 38. The operator then performs one or more of the following exercises as shown in FIGS. 11-14.

Figure 11A:
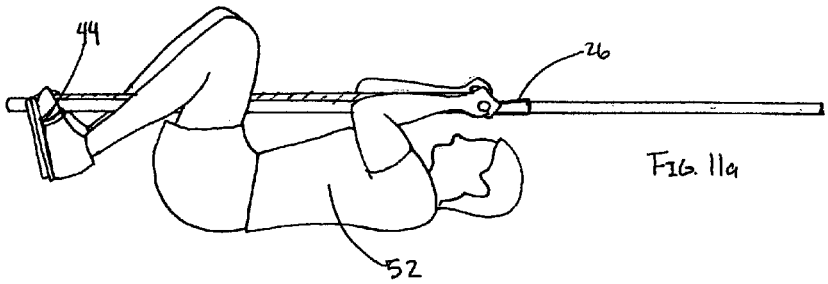
Figure 11B:
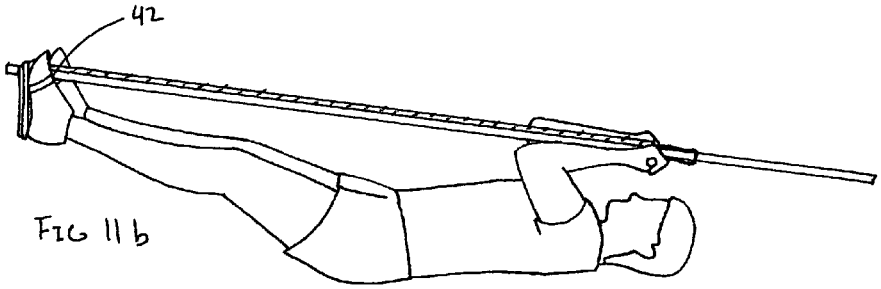

As shown in FIG. 11*a*, both feet of the operator 52 are placed into foot holders 44L and 44R and secured by tightening foot straps 42L and 42R. The operator 52 raises both hands to about the level of the face, and grasps handles 30L and 30R. As shown in FIG. 11*b*, operator 52 simultaneously pushes the foot boards 40 toward the distal end 49 using the legs and holds the handles 30L and 30R in place over in front of the face using the arms.

Figure 12A:
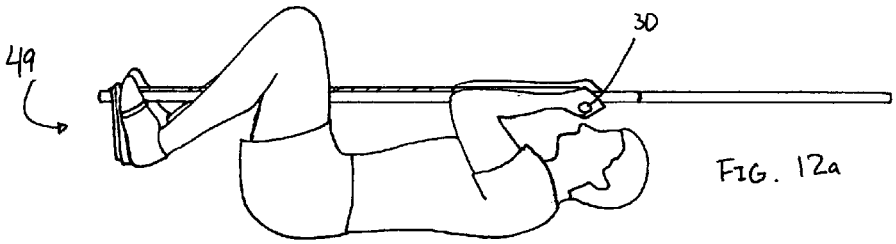
Figure 12B:
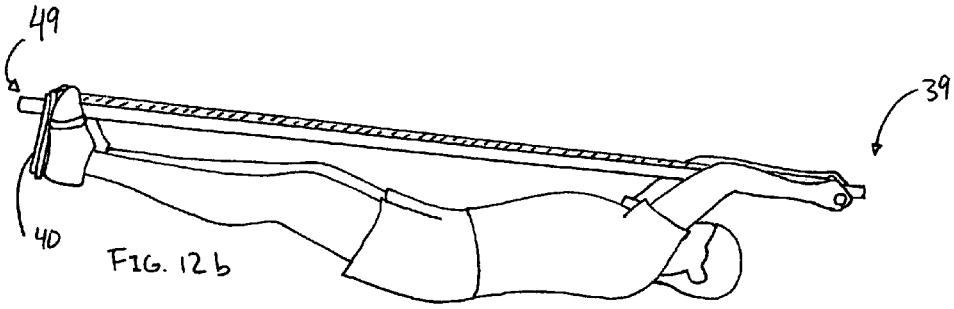

As shown in FIG. 12*a*, both feet of the operator 52 are placed into foot holders 44L and 44R and secured by tightening foot straps 42L and 42R. The operator 52 raises both hands to about the level of the face, and grasps handles 30L and 30R. As shown in FIG. 12*b*, operator 52 simultaneously pushes the foot boards 40 toward the distal end 49 using the legs and pushes the handles 30L and 30R toward the proximal end 39 using the arms.

Figure 13A:
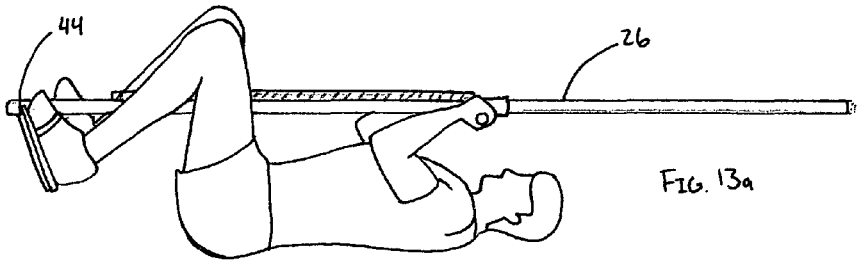
Figure 13B:
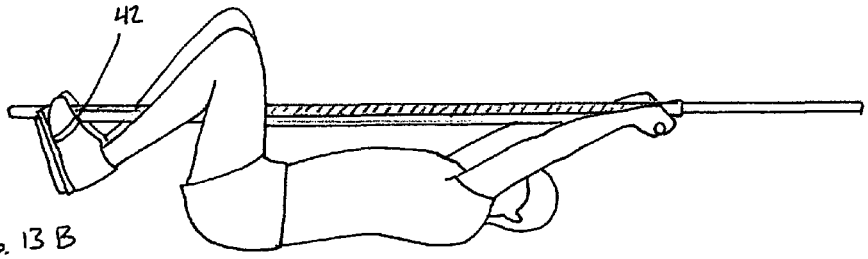

As shown in FIG. 13*a*, both feet of the operator 52 are placed into foot holders 44L and 44R and secured by tightening foot straps 42L and 42R. The operator 52 raises both hands to about the level of the face, and grasps handles 30L and 30R. As shown in FIG. 13*b*, operator 52 simultaneously pushes the handles 30L and 30R toward the proximal end 39 using the arms and holds the foot boards 40 in place using the legs.

Figure 14A:
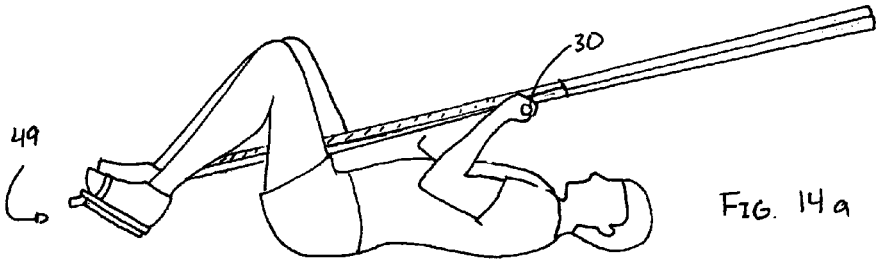
Figure 14B:
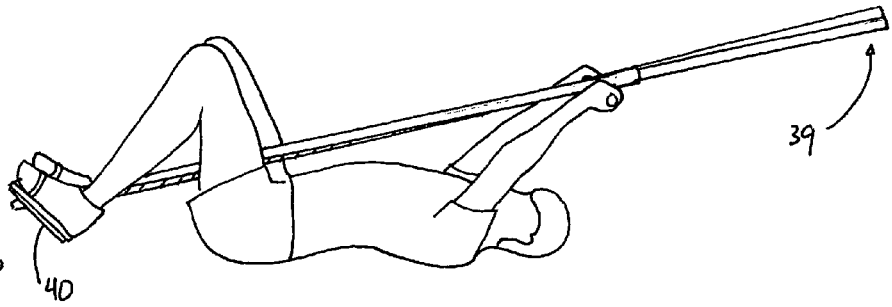

As shown in FIG. 14*a*, both feet of the operator 52 are placed into foot holders 44L and 44R and secured by tightening foot straps 42L and 42R. The operator 52 presses the foot boards 40 to the floor so that the distal end 49 is in contact with the floor, grasps handles 30L and 30R, and positions the hands and handles 30L and 30R to about the level of the neck. As shown in FIG. 14*b*, operator 52 simultaneously pushes the handles 30L and 30R toward the proximal end 39 using the arms and holds the foot boards 40 in place and in contact with the floor using the legs. The exercise shown in FIG. 14 is also performed with only one arm of the operator 52 grasping one of the handles 30L or 30R and pushing that handle 30L or 30R toward the proximal end 39.

Exercises are also performed by the operator 52 standing and using the exercise system 26 in the first configuration. At least one resistance band 54 is secured to one or more band anchors 32L and/or 32R and to band anchors 34L and/or 34R. The operator then performs one or more of the following exercises as shown in FIGS. 16-25.

Figure 16A:
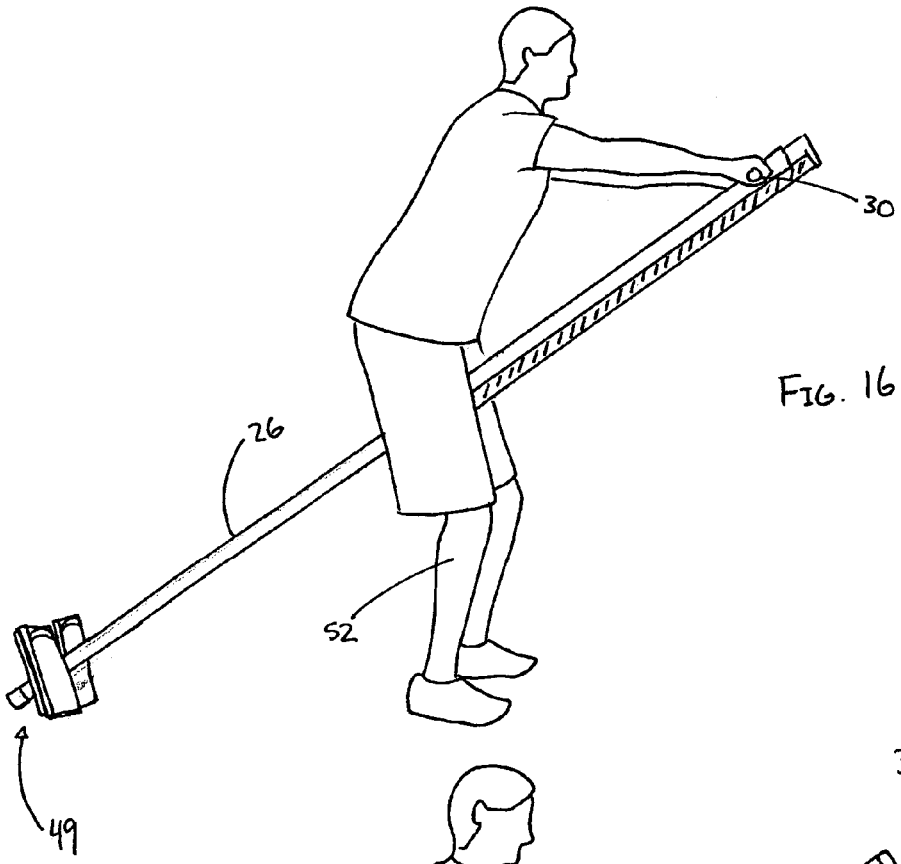
Figure 16B:
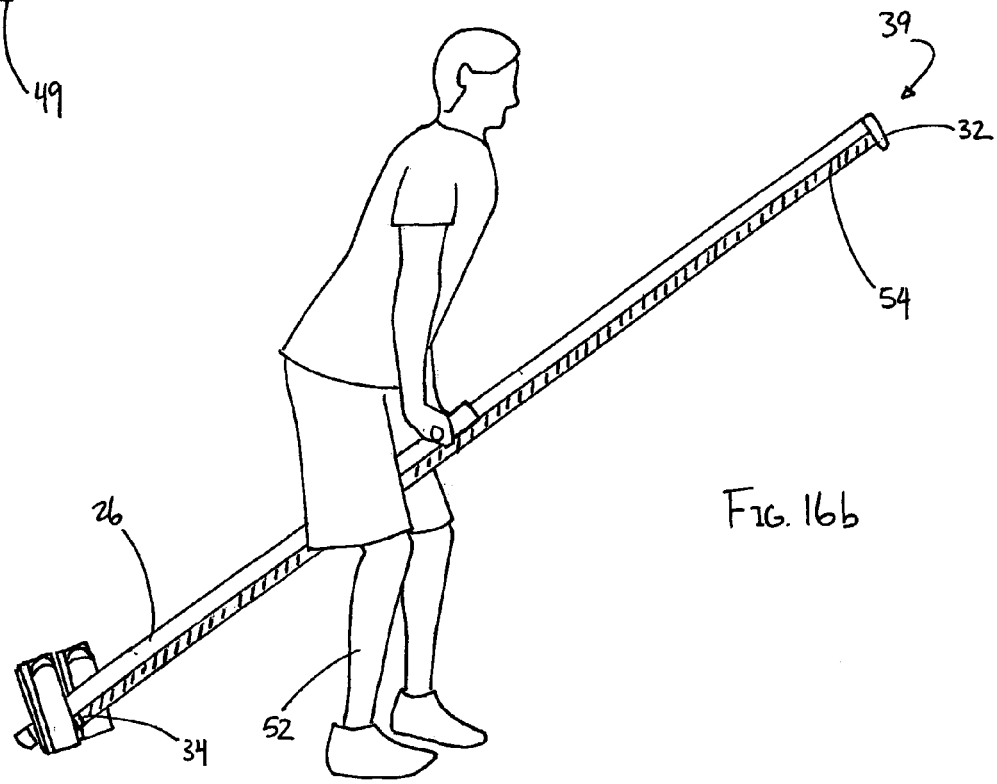

As shown in FIG. 16*a*, the operator 52 places the exercise system 26 between the legs, positions the exercise system 26 at an angle with the floor as shown in FIG. 16*a* with the distal end 49 in contact with a wall and/or floor, as also depicted in FIG. 3*a*, grasps handles 30L and 30R, and stands and maintains the back in an upright position. As shown in FIG. 16*b*, operator 52 simultaneously pulls the handles 30L and 30R toward the distal end 49 using the arms and holds the distal end 49 in position against the floor and/or wall.

Figure 17A:
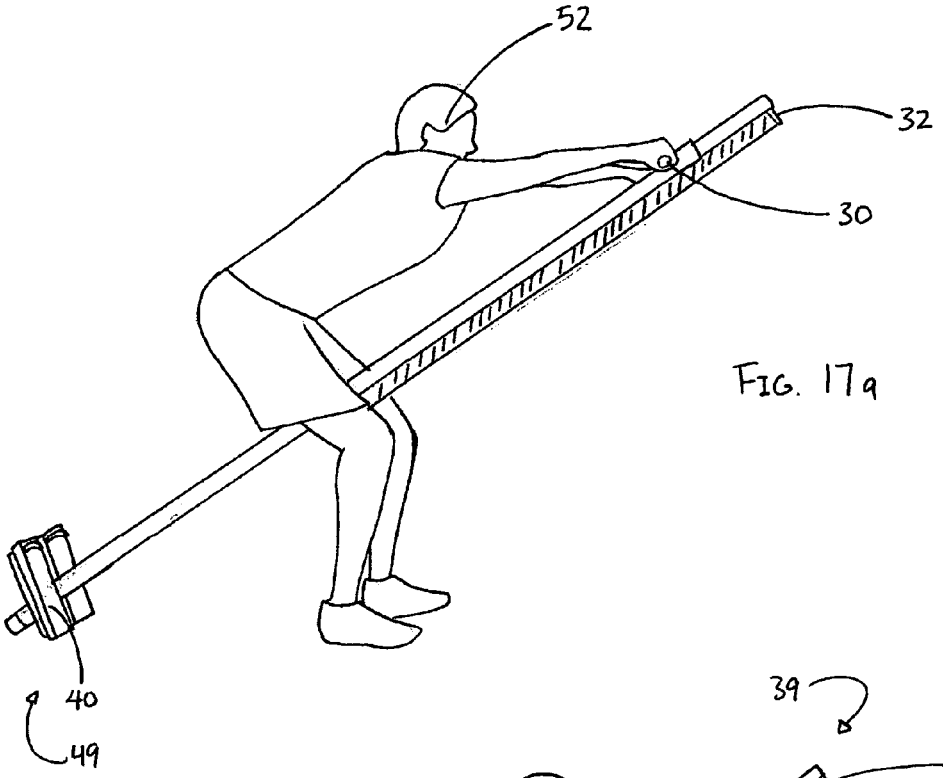
Figure 17B:
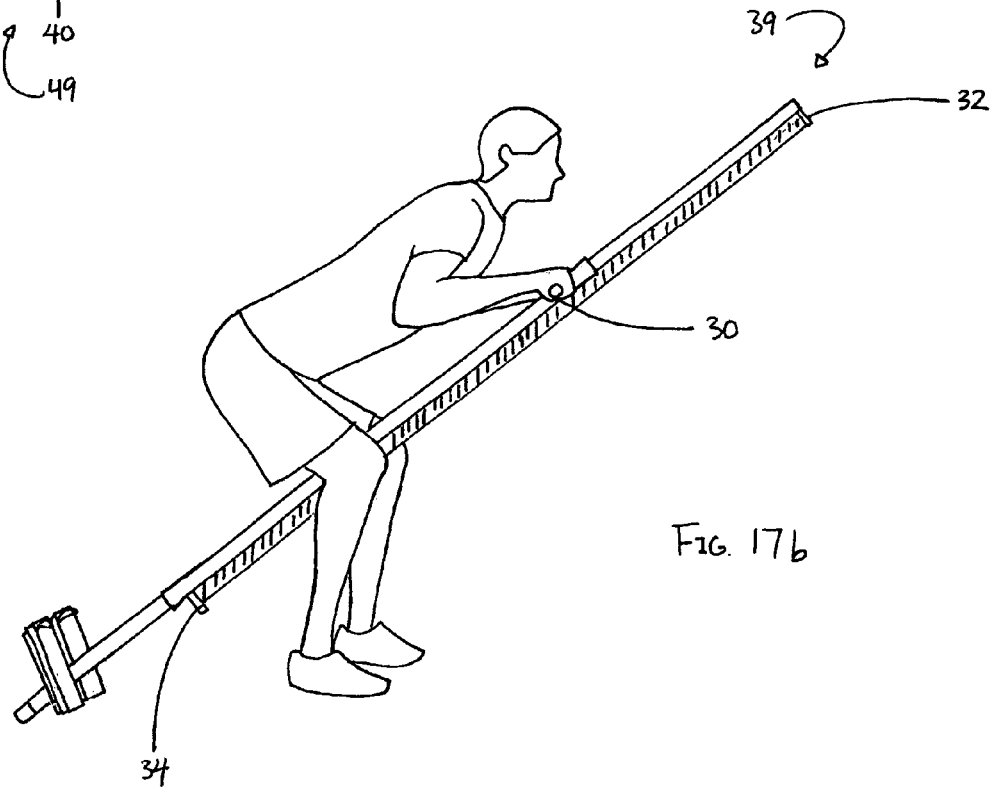

As shown in FIG. 17*a*, the operator 52 places the exercise system 26 between the legs, positions the exercise system 26 at an angle with the floor as shown in FIG. 17*a* with the distal end 49 against a wall and/or floor, as also depicted in FIG. 3*a*, grasps handles 30L and 30R, stands and bends the upper body forward at the waist, and maintains the position of the upper body bent forward at the waist. As shown in FIG. 17*b*, operator 52 simultaneously pulls the handles 30L and 30R toward the distal end 49 and the wall and/or floor using the arms and holds the distal end 49 in position against the floor and/or wall.

Figure 18A:
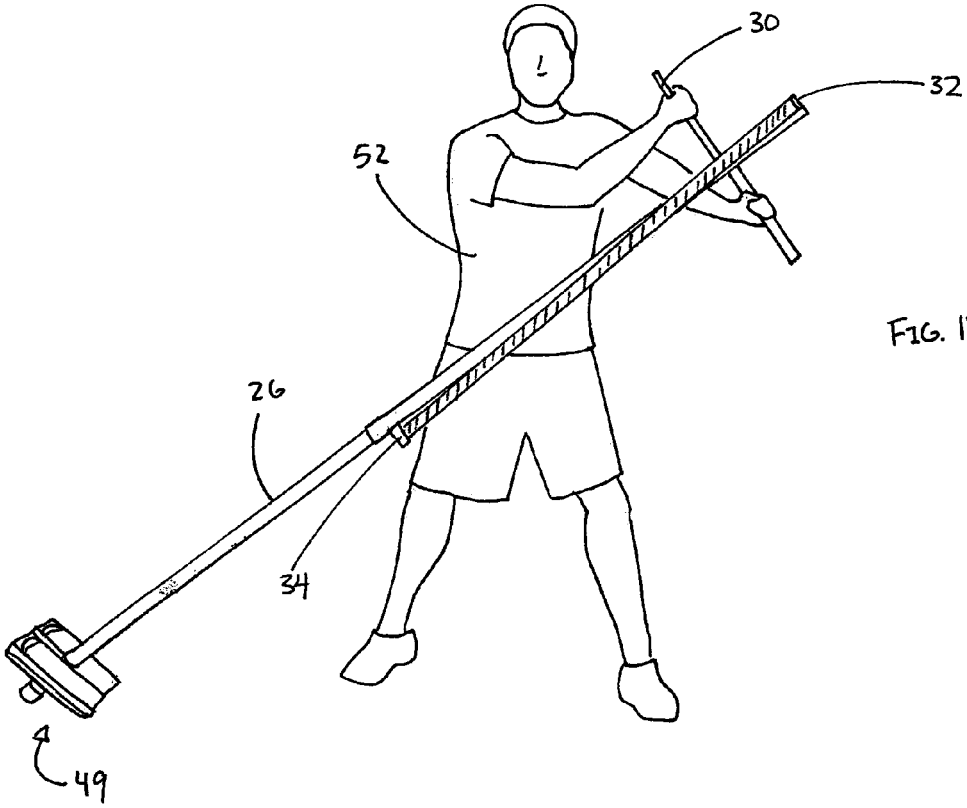
Figure 18B:
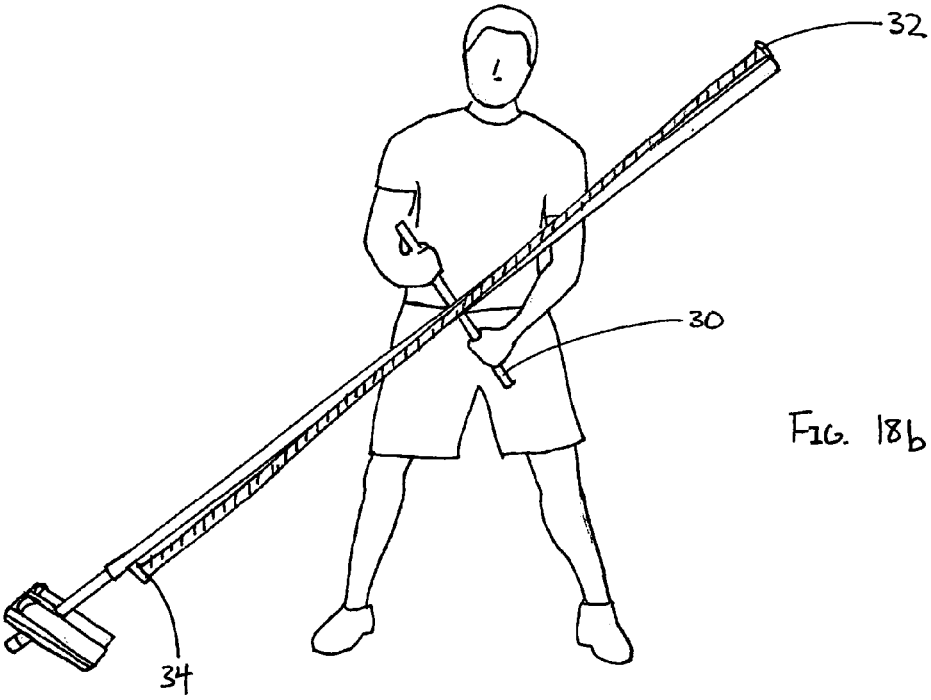

As shown in FIG. 18*a*, the operator 52 places the exercise system 26 in front of the body, positions the exercise system 26 at an angle with the floor as shown in FIG. 18*a* with the distal end 49 in contact with a wall and/or floor, as also depicted in FIG. 3*a*, grasps handles 30L and 30R, and stands and maintains the back in an upright position. As shown in FIG. 18*b*, operator 52 simultaneously pulls the handles 30L and 30R across the front of the body toward the distal end 49 using the arms and holds the distal end 49 in position against the floor and/or wall.

Figure 19A:
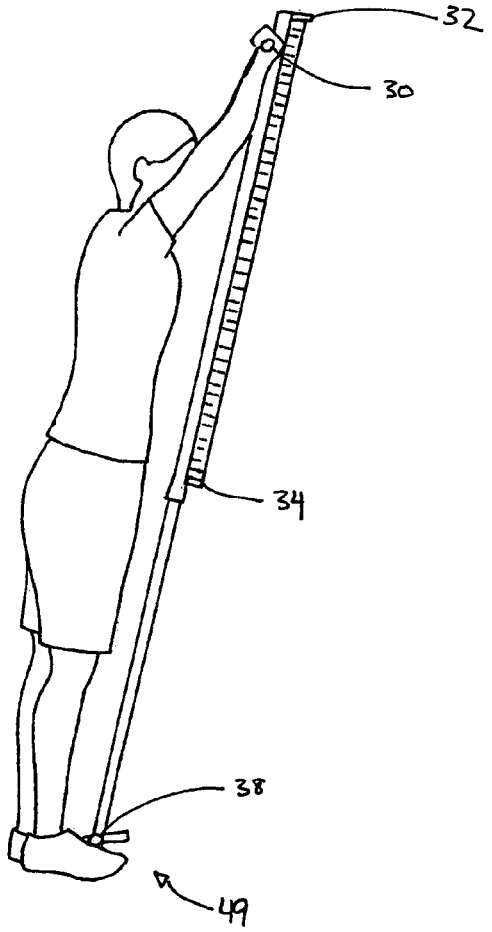
Figure 19B:
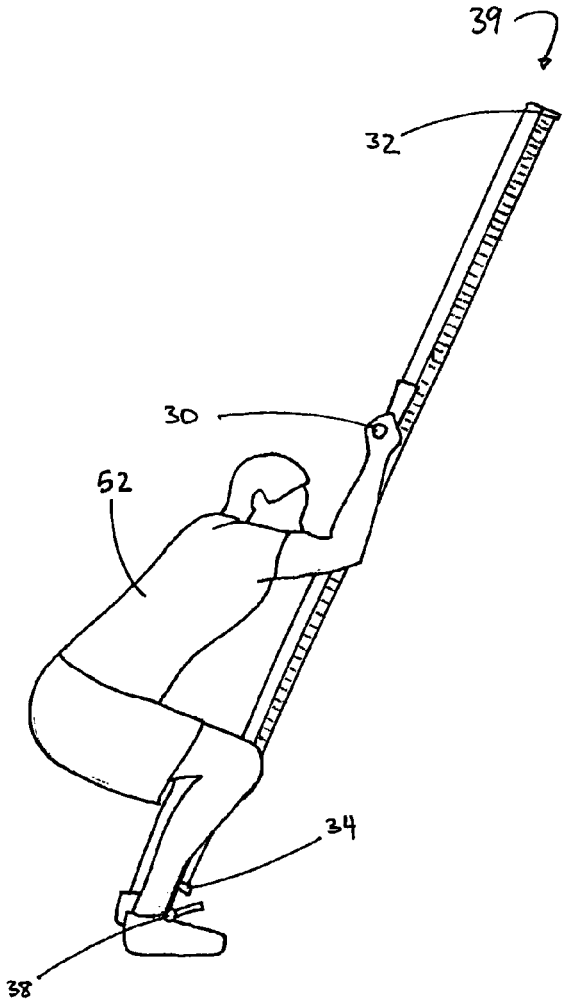

As shown in FIG. 19*a*, the operator 52 places the exercise system 26 in front of the body, positions the distal end 49 between the feet and the exercise system 26 in a vertical orientation with the proximal end 39 directed toward the ceiling and the distal end 49 in contact with the floor, stands upright, raises both hands over the head, and grasps handles 30L and 30R. As shown in FIG. 19*b*, operator 52 simultaneously pulls the handles 30L and 30R toward the floor and the distal end 49 by flexing the arms and the legs and bending the body into a squatting position with the legs and arms bent and holds the distal end 49 in position against the floor.

Figure 20A:
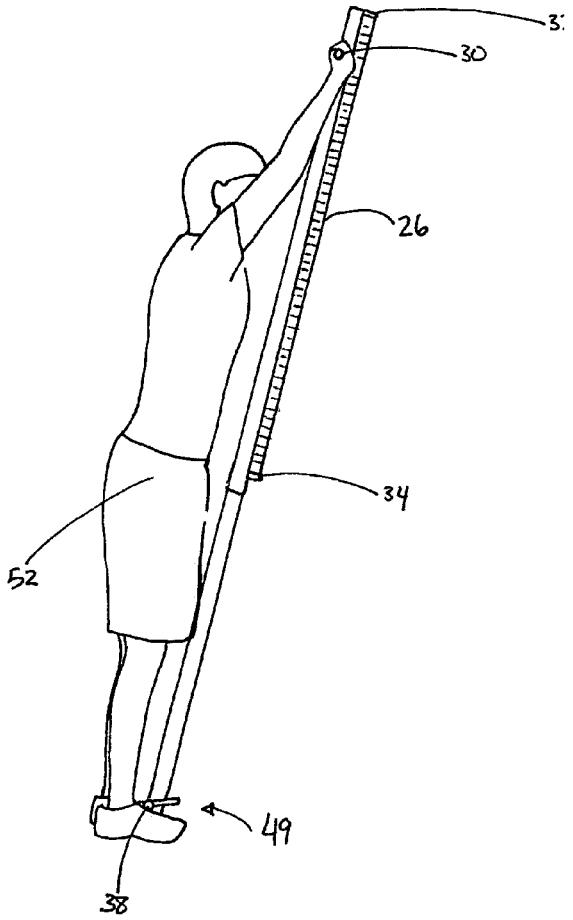
Figure 20B:
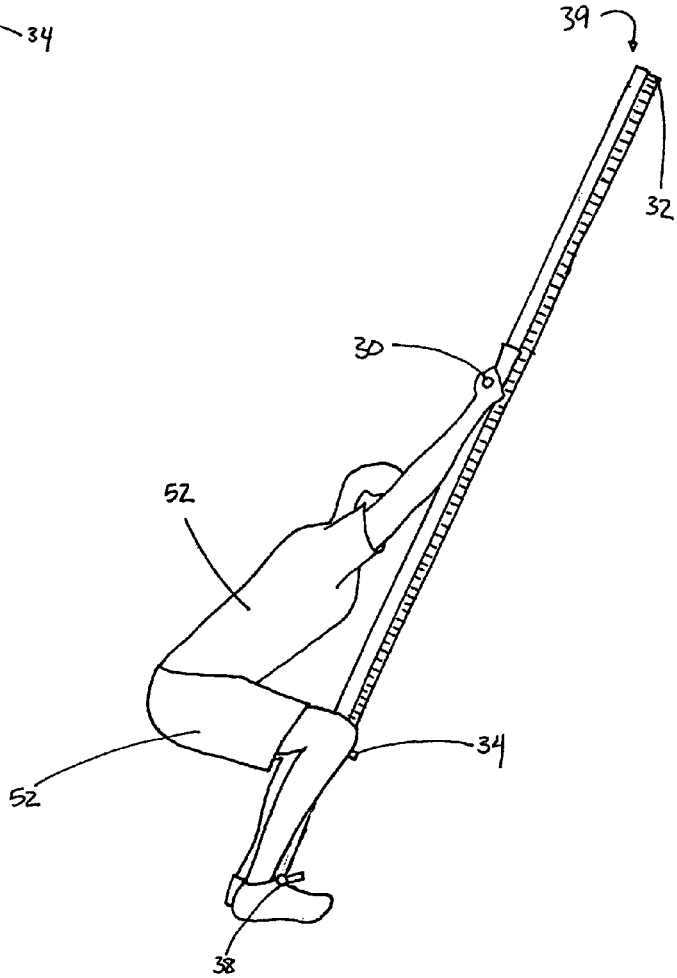

As shown in FIG. 20*a*, the operator 52 places the exercise system 26 in front of the body, positions the distal end 49 between the feet and the exercise system 26 in a vertical orientation with the proximal end 39 directed toward the ceiling and the distal end 49 in contact with the floor, stands upright, raises both hands over the head, and grasps handles 30L and 30R. As shown in FIG. 20*b*, operator 52 simultaneously pulls the handles 30L and 30R toward the floor and the distal end 49 by flexing the legs without bending the arms and bending the body into a squatting position with the legs bent and the arms straight and holds the distal end 49 in position against the floor.

Figure 21A:
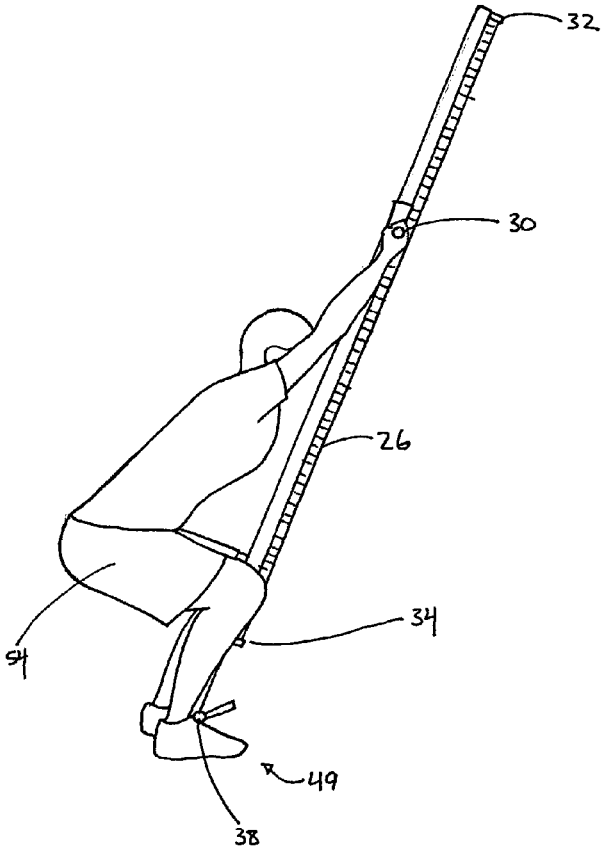
Figure 21B:
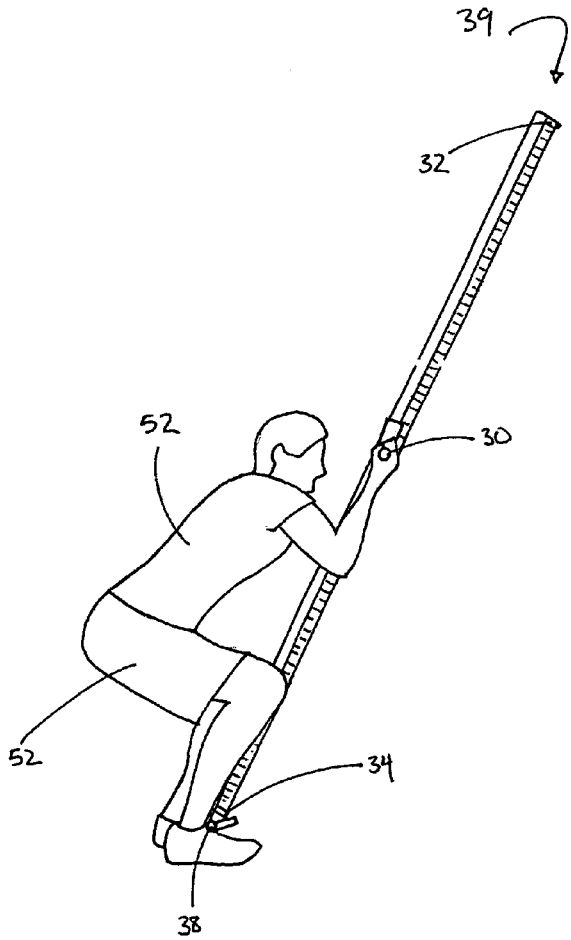

As shown in FIG. 21*a*, the operator 52 places the exercise system 26 in front of the body, positions the distal end 49 between the feet and the exercise system 26 in a vertical orientation with the proximal end 39 directed toward the ceiling and the distal end 49 in contact with the floor, stands upright, raises both hands over the head, grasps handles 30L and 30R, and first pulls the handles 30L and 30R toward the floor and the distal end 49 by flexing the legs without bending the arms and bending the body into a squatting position. As shown in FIG. 21*b*, operator 52 then flexes the arms and pulls the handles 30L and 30R closer to the distal end 49 and floor, and simultaneously holds the distal end 49 in position against the floor.

Figure 22A:
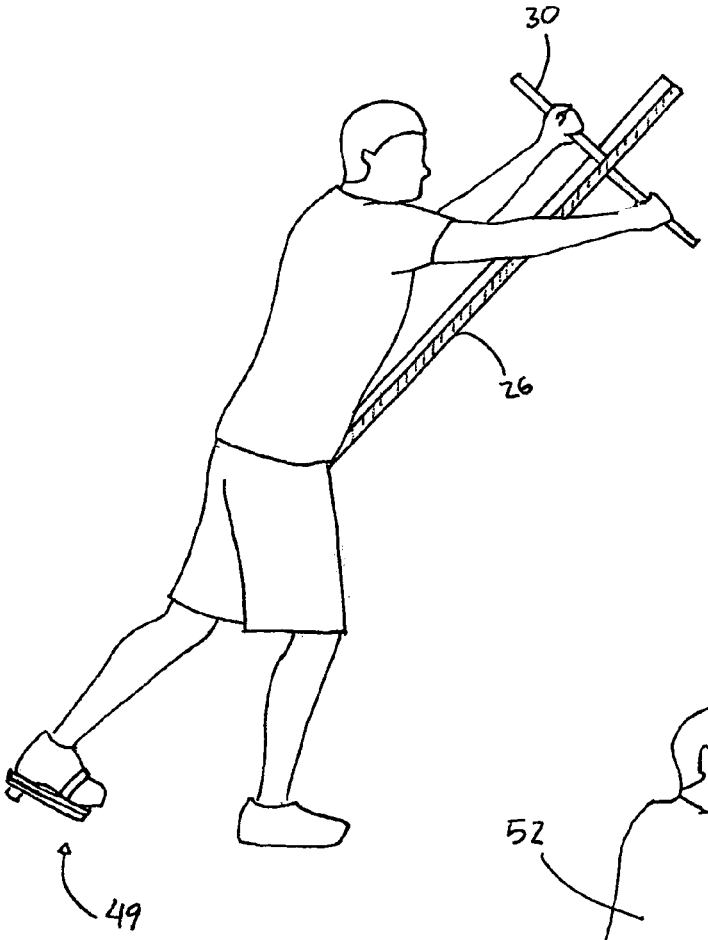
Figure 22B:
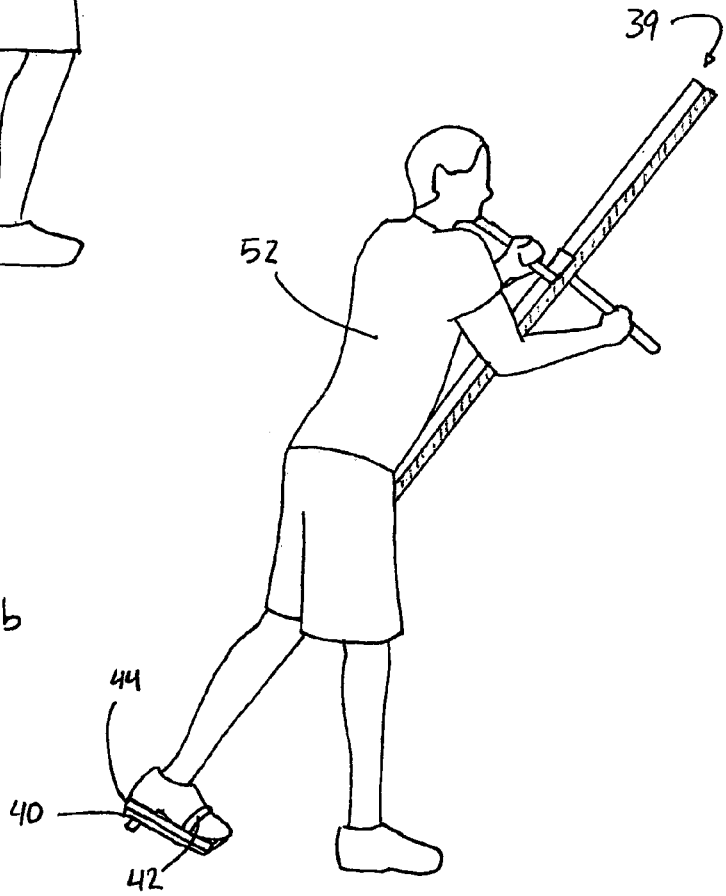

As shown in FIG. 22*a*, the operator 52 places the exercise system 26 on the left side of the body, places the left foot in one of the foot holders 44L or 44R and secures it by tightening foot strap 42L or 42R, positions the exercise system 26 at an angle with the floor as shown in FIG. 22 with the distal end 49 in contact with the floor, or with the distal end 49 against a wall and/or floor as depicted in FIG. 3*a*, grasps handles 30L and 30R, and stands on the right leg and maintains the back in an upright position. As shown in FIG. 22*b*, operator 52 simultaneously pulls the handles 30L and 30R toward the body and toward the distal end 49 using the arms and holds the distal end 49 in position against the floor. The exercise shown in FIG. 22 is also performed with the opposite extremities, such that the operator 52 places the exercise system 26 on the right side of the body, places the right foot in one of the foot holders 44L or 44R and secures it by tightening foot strap 42L or 42R, positions the exercise system 26 at an angle with the floor as shown in FIG. 22 with the distal end 49 in contact with the floor, grasps handles 30L and 30R, stands on the left leg and maintains the back in an upright position, and simultaneously pulls the handles 30L and 30R toward the body and toward the distal end 49 using the arms and holds the distal end 49 in position against the floor.

Figure 23A:
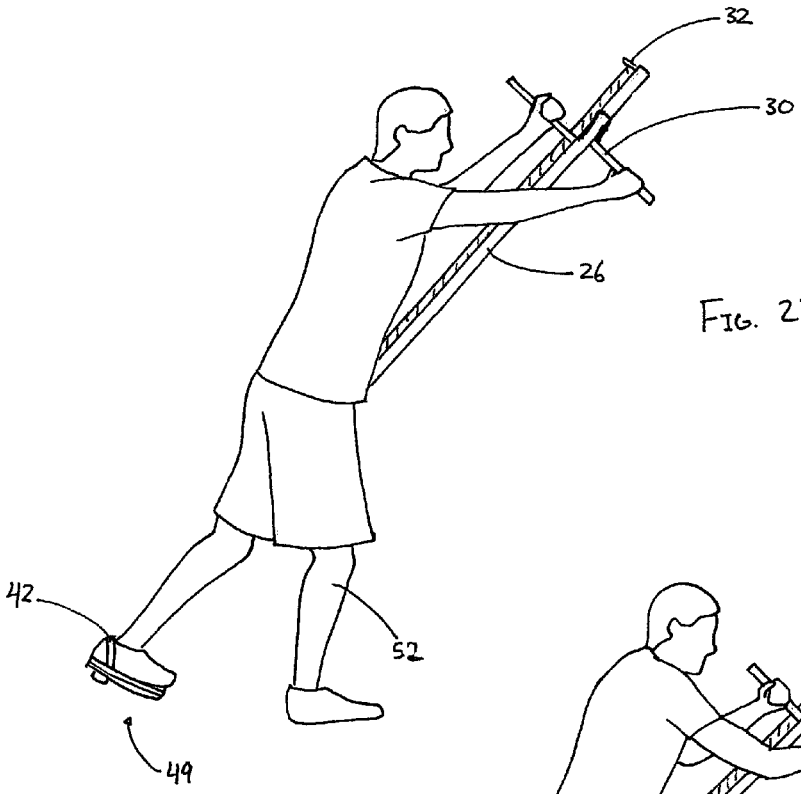
Figure 23B:
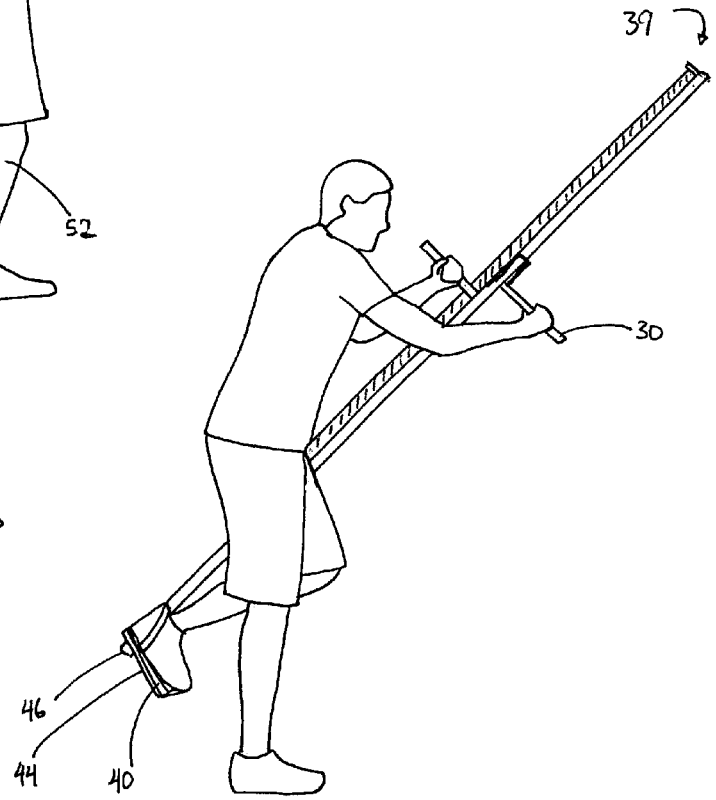

As shown in FIG. 23*a*, the operator 52 places the exercise system 26 on the left side of the body, places the left foot in one of the foot holders 44L or 44R and secures it by tightening foot strap 42L or 42R, positions the exercise system 26 at an angle with the floor as shown in FIG. 23*a* with the distal end 49 in contact with the floor, or with the distal end 49 against a wall and/or floor as depicted in FIG. 3*a*, grasps handles 30L and 30R, and stands on the right leg and maintains the back in an upright position. As shown in FIG. 23*b*, operator 52 simultaneously pulls the handles 30L and 30R toward the body and toward the distal end 49 using the arms and pulls the foot boards 40 up off the floor toward the proximal end 39 using the left leg and remains standing on the right leg. The exercise shown in FIG. 23 is also performed with the opposite extremities, such that the operator 52 places the exercise system 26 on the right side of the body, places the right foot in one of the foot holders 44L or 44R and secures it by tightening foot strap 42L or 42R, positions the exercise system 26 at an angle with the floor as shown in FIG. 23 with the distal end 49 in contact with the floor, grasps handles 30L and 30R, stands on the left leg and maintains the back in an upright position, and simultaneously pulls the handles 30L and 30R toward the body and toward the distal end 49 using the arms and pulls the foot boards 40 up off the floor toward the proximal end 39 using the right leg and remains standing on the left leg.

Figure 24A:
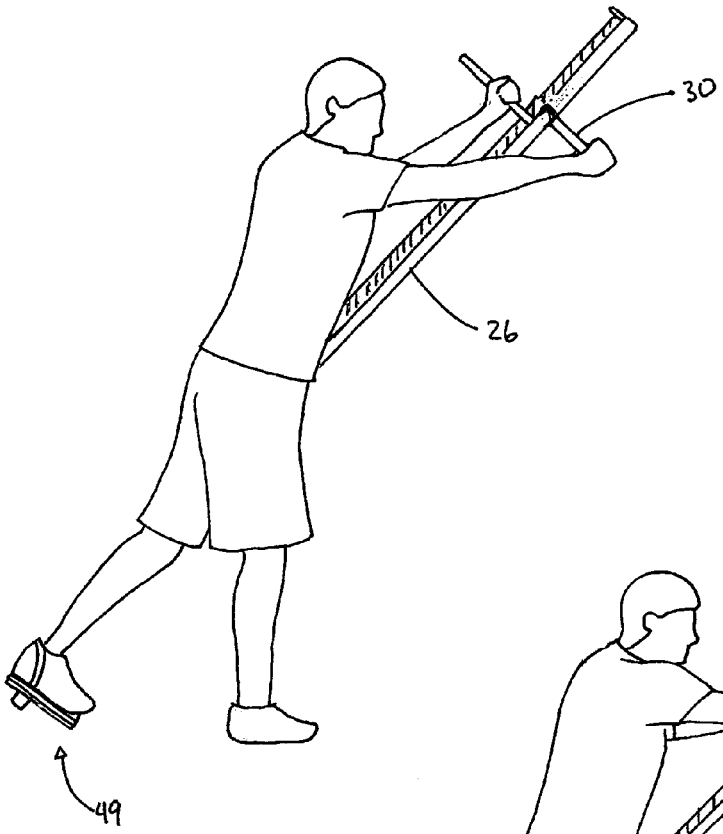
Figure 24B:
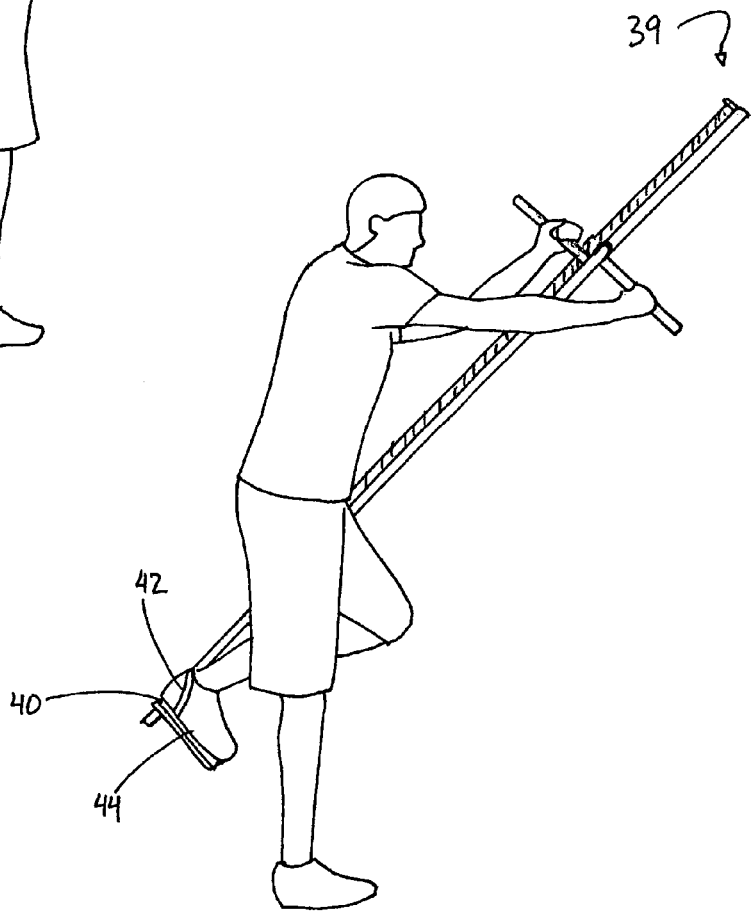

As shown in FIG. 24*a*, the operator 52 places the exercise system 26 on the left side of the body, places the left foot in one of the foot holders 44L or 44R and secures it by tightening foot strap 42L or 42R, positions the exercise system 26 at an angle with the floor as shown in FIG. 24*a* with the distal end 49 in contact with the floor, or with the distal end 49 against a wall and/or floor as depicted in FIG. 3*a*, grasps handles 30L and 30R, and stands on the right leg and maintains the back in an upright position. As shown in FIG. 24*b*, operator 52 simultaneously pulls the foot boards 40 up off the floor toward the proximal end 39 using the left leg and remains standing on the right leg and holds the handles 30L and 30R in place using the arms. The exercise shown in FIG. 24 is also performed with the opposite extremities, such that the operator 52 places the exercise system 26 on the right side of the body, places the right foot in one of the foot holders 44L or 44R and secures it by tightening foot strap 42L or 42R, positions the exercise system 26 at an angle with the floor as shown in FIG. 24 with the distal end 49 in contact with the floor, grasps handles 30L and 30R, stands on the left leg and maintains the back in an upright position, and simultaneously pulls the foot boards 40 up off the floor toward the proximal end 39 using the right leg and remains standing on the left leg and holds the handles 30L and 30R in place using the arms.

Figure 25A:
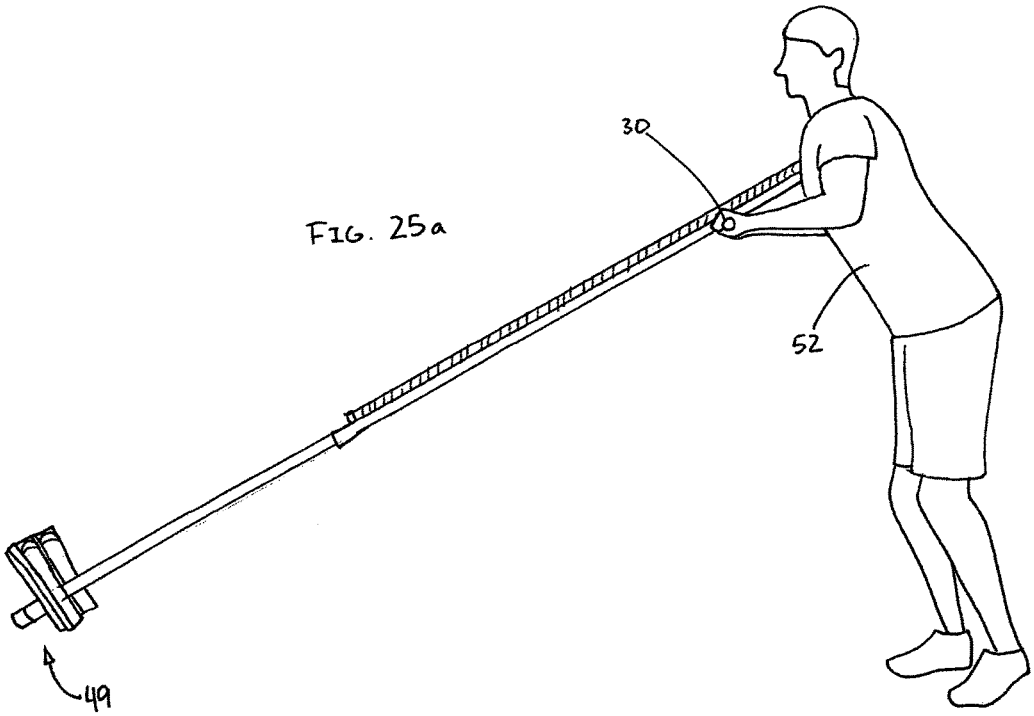
Figure 25B:
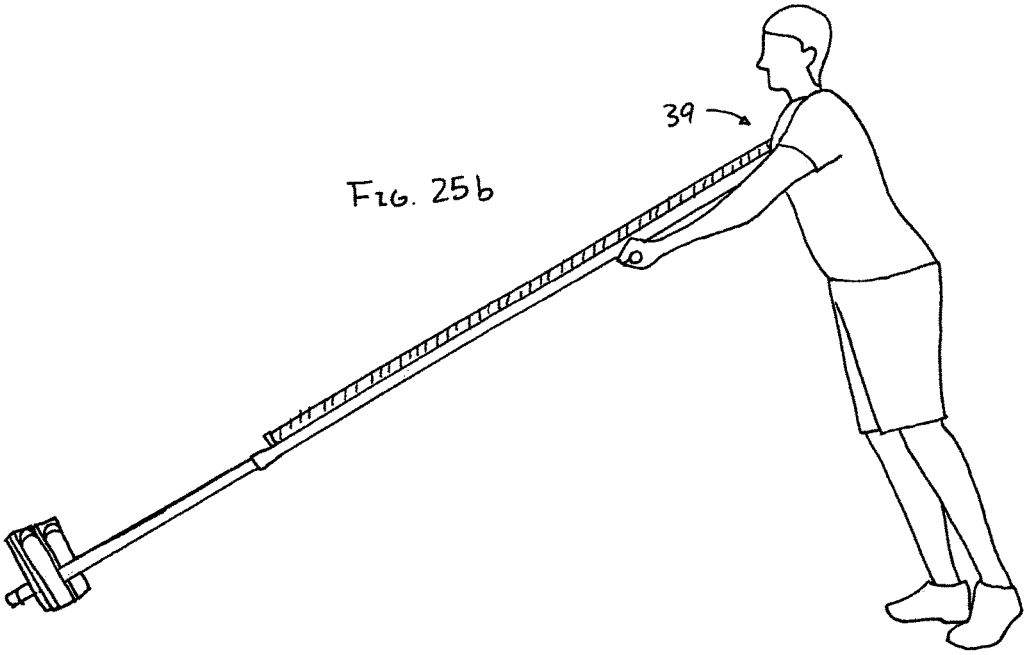

As shown in FIG. 25*a*, the operator 52 places the exercise system 26 in front of the body, positions the exercise system 26 at an angle with the floor as shown in FIG. 25*a* with the distal end 49 in contact with a wall and/or floor, as also depicted in FIG. 3*a*, positions the proximal end 39 in contact with the chest, grasps handles 30L and 30R, stands and leans forward toward the exercise system 26, and maintains the back and legs in a straight position. As shown in FIG. 25*b*, operator 52 simultaneously pushes the handles 30L and 30R toward the distal end 49 using the arms and holds the distal end 49 in position against the floor and/or wall. The exercise shown in FIG. 25 is also performed with the exercise system 26 parallel to the floor with the distal end 49 in contact with the wall at a location on the wall above the floor.

Exercises are also performed by the operator 52 standing and using the exercise system 26 in the first configuration. At least one resistance band 54 is secured to one or more band anchors 32L and/or 32R and to the band anchors 34L and 34R. The operator then performs one or more of the following exercises as shown in FIGS. 26-32.

Figure 26B:
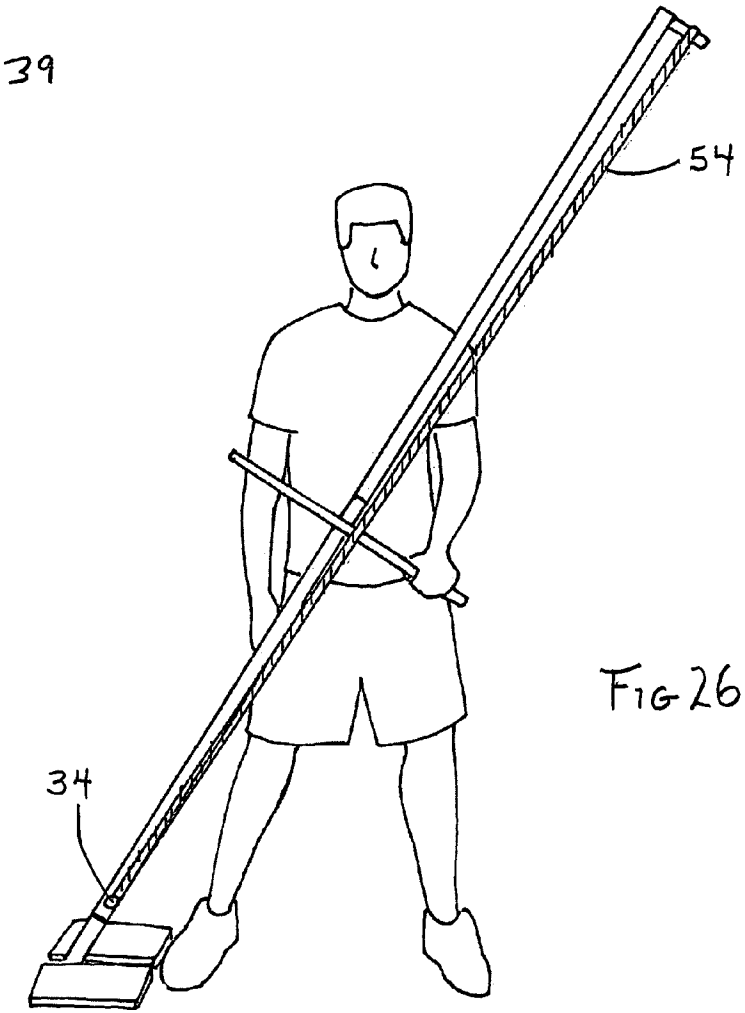
Figure 26A:
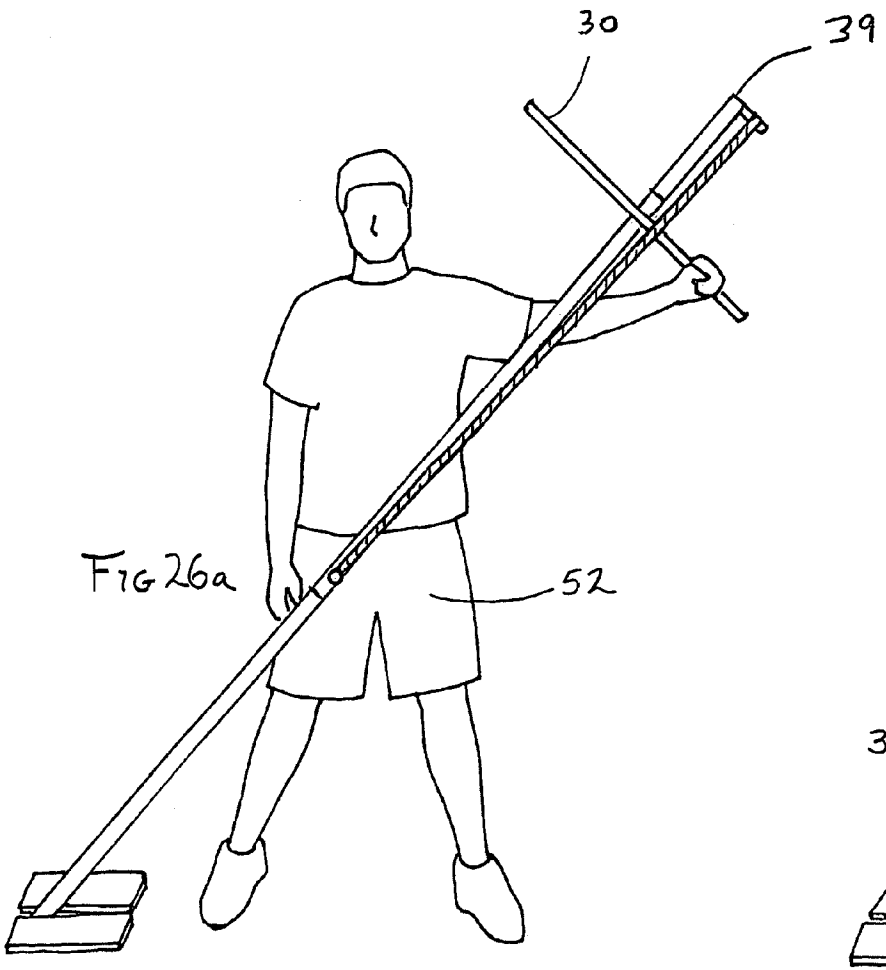
Figure 26C:
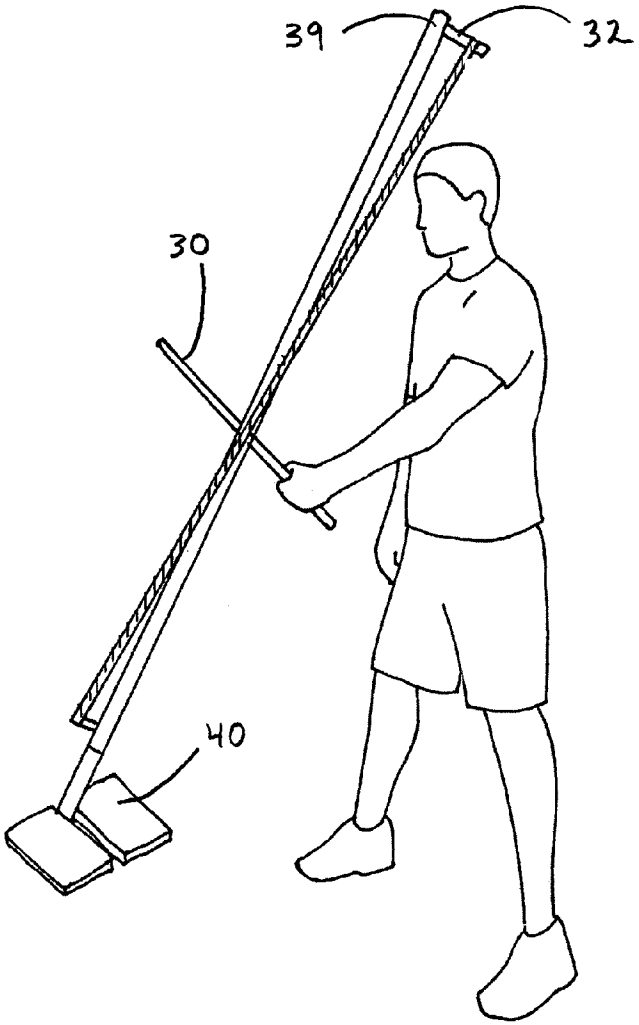

As shown in FIG. 26, the operator 52 places the exercise system 26 diagonally across the front of the body with distal end 49 in contact with the floor or a solid object, one hand grasps the handle 30L or 30R with the arm straight and parallel to the floor and holds the handle 30 diagonal to the floor, as shown in FIG. 26*a*. Keeping the arm straight and holding the handle 30 diagonal to the floor, the operator pulls the handle 30L or 30R downward and moves the proximal end 39 of the elongated member 27 away from the front of the body as shown in FIGS. 26*b* and 26*c*.

Figure 27B:
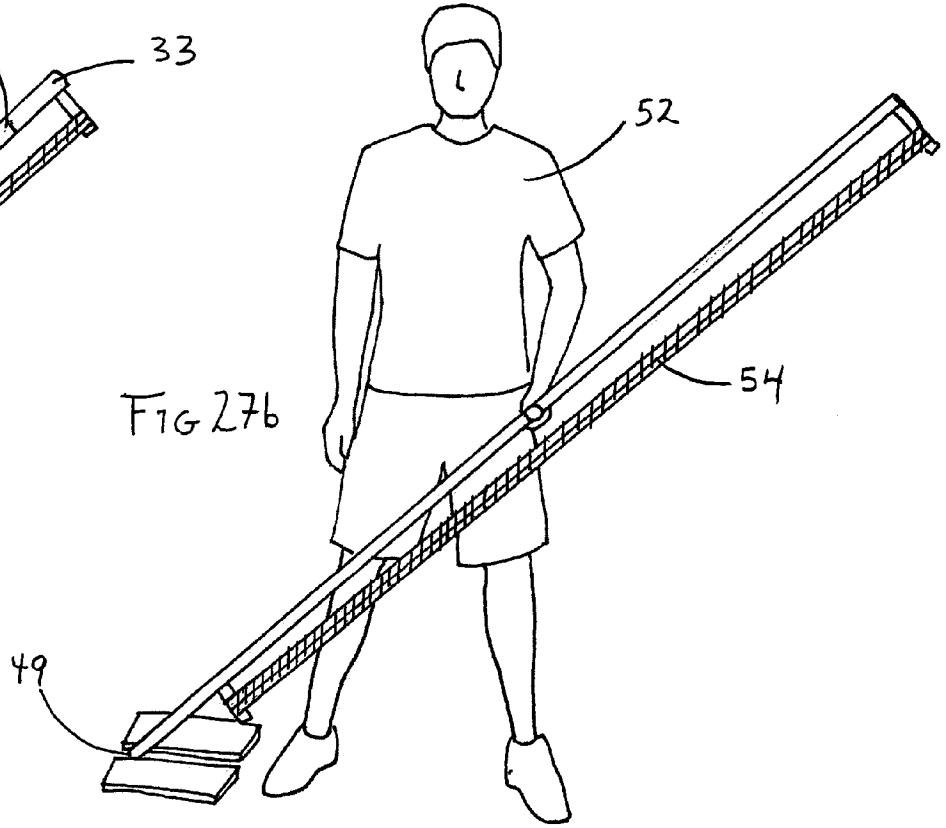
Figure 27A:
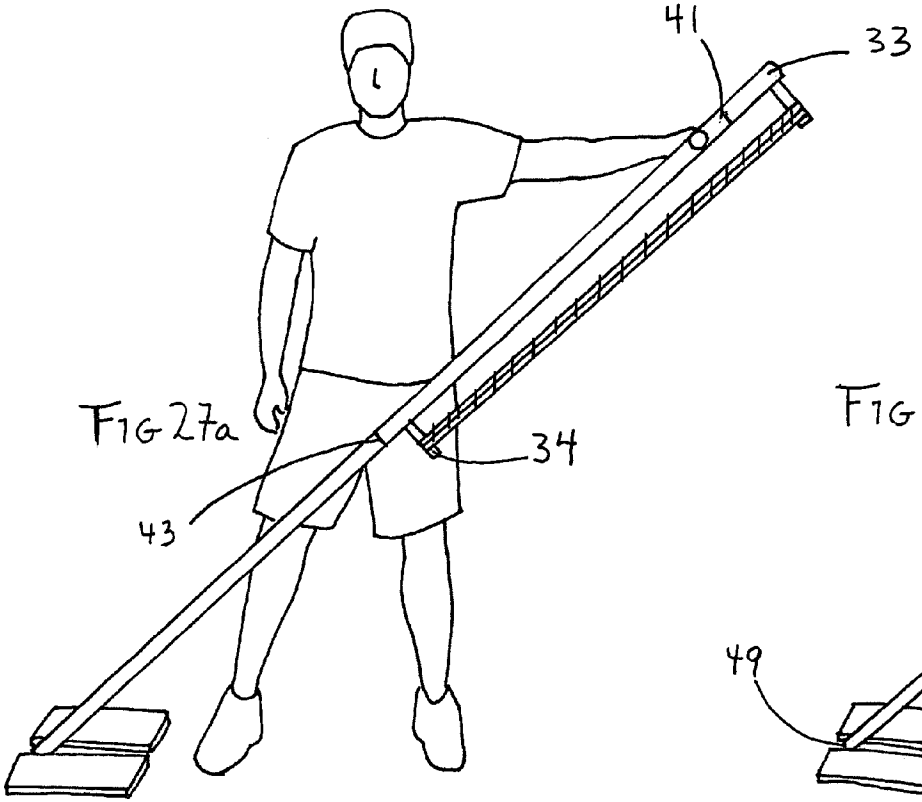

As shown in FIG. 27, the operator 52 places the exercise system 26 diagonally across the front of the body with distal end 49 in contact with the floor or a solid object, grasps the handle 30L or 30R with one hand, with the arm straight holds the handle 30 parallel to the floor, and steps towards the distal end of the elongated member 27 until the arm grasping the handle 30L or 30R is parallel to the floor, and the elongated member 27 and hollow tube 28 are touching the body. Keeping the arm straight and holding the handle 30 parallel to the floor, the operator pulls the handle 30L or 30R downward to the side of the body as shown in FIG. 27*b*.

Figure 28B:
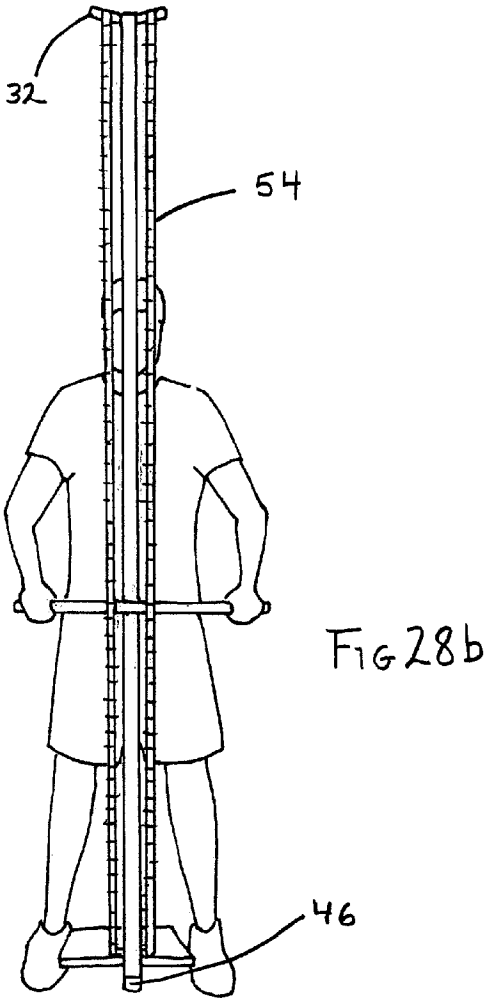
Figure 28A:
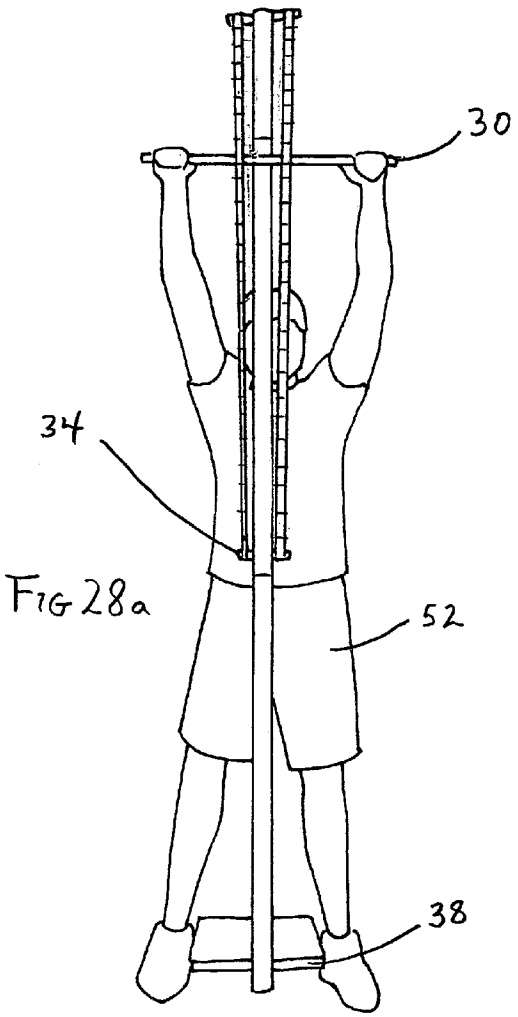

As shown in FIG. 28, the operator 52 places the exercise system 26 upright in front of the body with the distal end 49 in contact with the floor or a solid object and the feet in contact with the foot board tube 38, reaches one or both hands over the head and grasps handles 30L and/or 30R, as shown in FIG. 28A. Keeping the arms straight or slightly bent, the operator then pulls the handles downward toward the distal end 49 until the hollow member 28 cannot be moved farther, as shown in FIG. 28*b*.

Figure 29A:
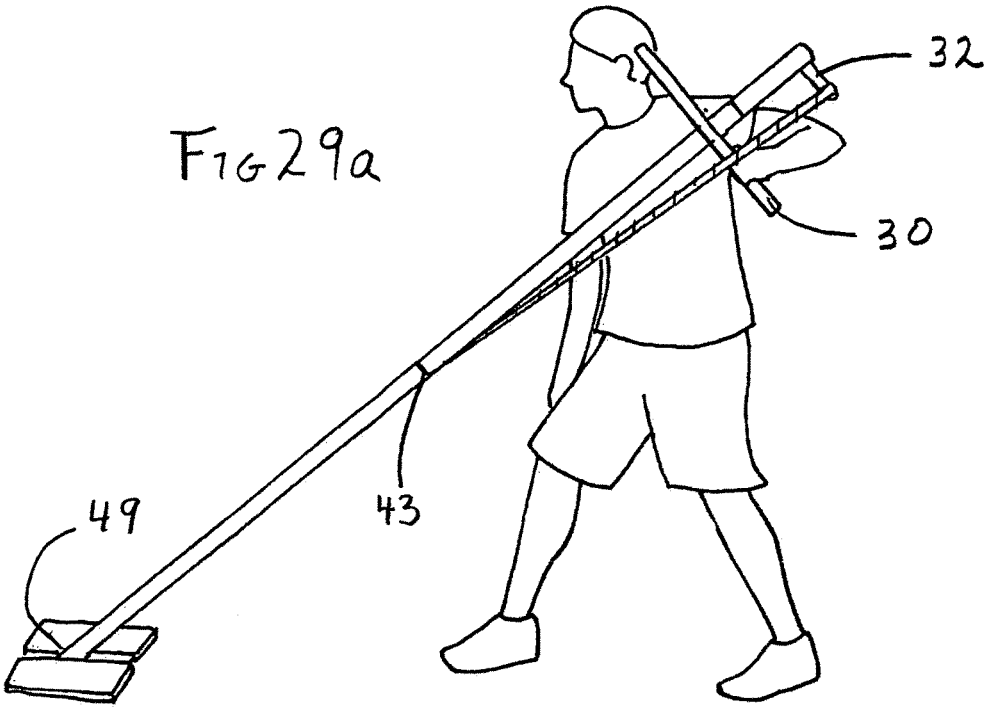
Figure 29B:
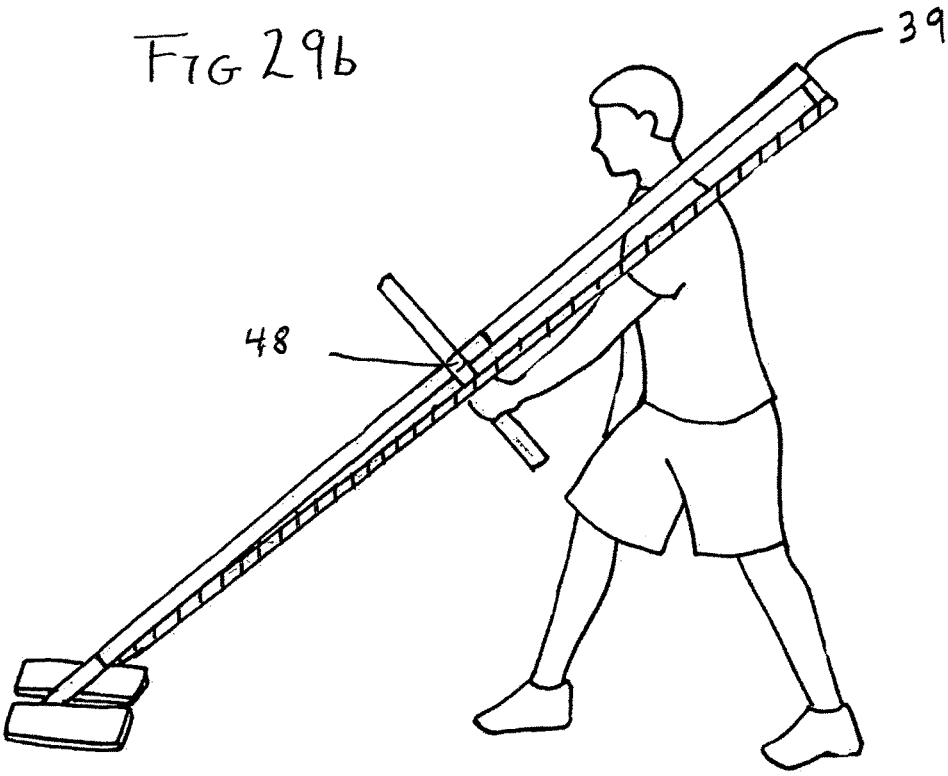

As shown in FIG. 29 the operator 52 places the exercise system 26 on the left side of the body diagonally to the floor with the distal end 49 in front of the body and in contact with the floor or a solid object and the handle 30 diagonal to the floor, stands facing the distal end 49 with the right leg forward, grasps the handle 30L with the left hand and raises it to just below or at shoulder level with the arm bent and the proximal end 39 close to or in contact with the body as shown in FIG. 29*a*. The operator 52 then pushes the handle 30 downward toward the distal end 49 as shown in FIG. 29*b*. The exercise shown in FIG. 29 can also be performed on either side of the body and/or with the exercise system 26 placed at various angles relative to the floor.

Figure 30B:
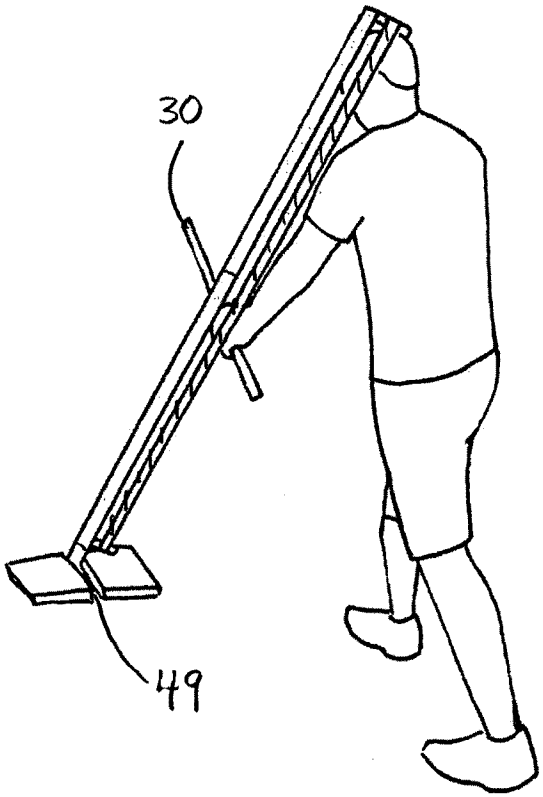
Figure 30A:
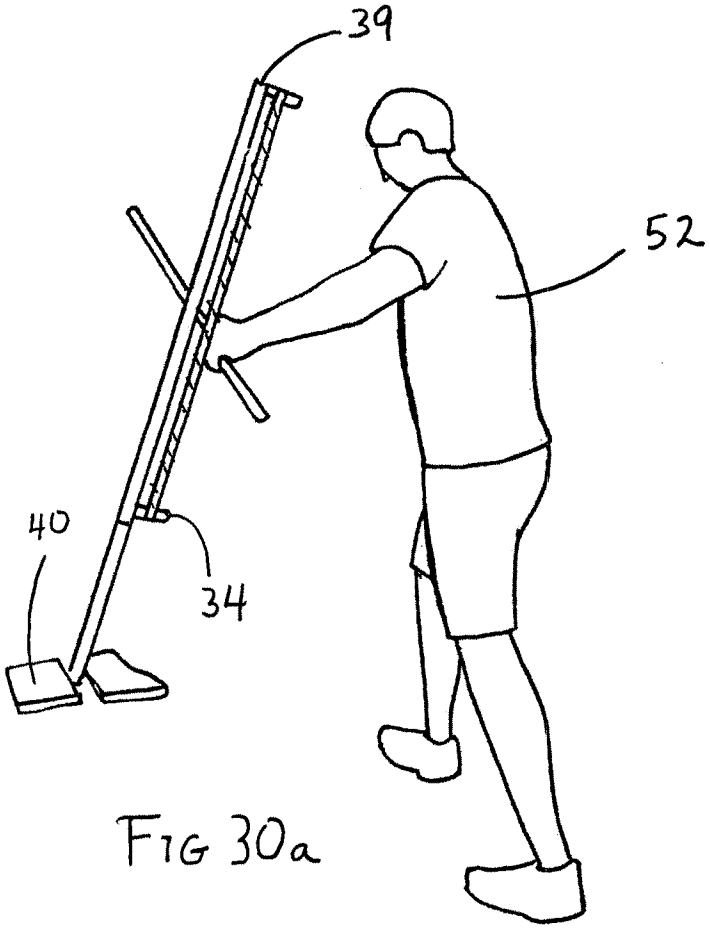

As shown in FIG. 30 the operator 52 places the exercise system 26 on the left side of the body diagonally to the floor with the distal end 49 in front of the body and in contact with the floor or a solid object and the handle 30 diagonal to the floor, stands facing the distal end 49 with the right leg forward, grasps the handle 30L with the left hand and raises it to just below or at shoulder level with the left arm straight, with the proximal end 39 at about an arm length away from the body as shown in FIG. 30*a*. The operator 52 then pushes the handle 30 downward toward the distal end 49 and medially toward the body as shown in FIG. 30*b*. The exercise shown in FIG. 30 can also be performed on either side of the body and/or with the exercise system 26 placed at various angles relative to the floor.

Figure 31B:
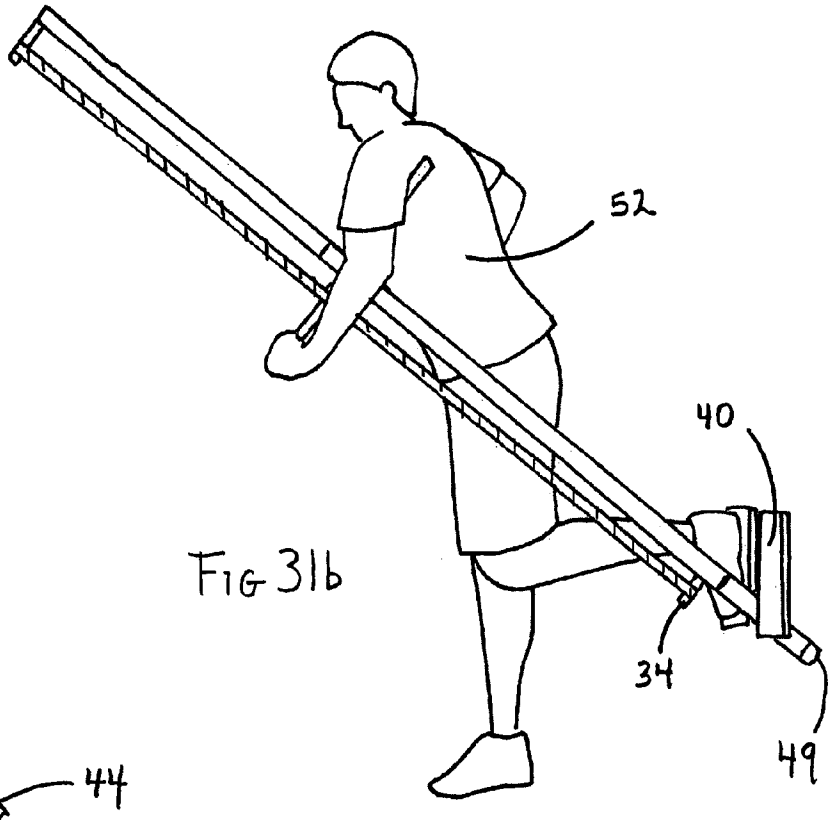
Figure 31A:
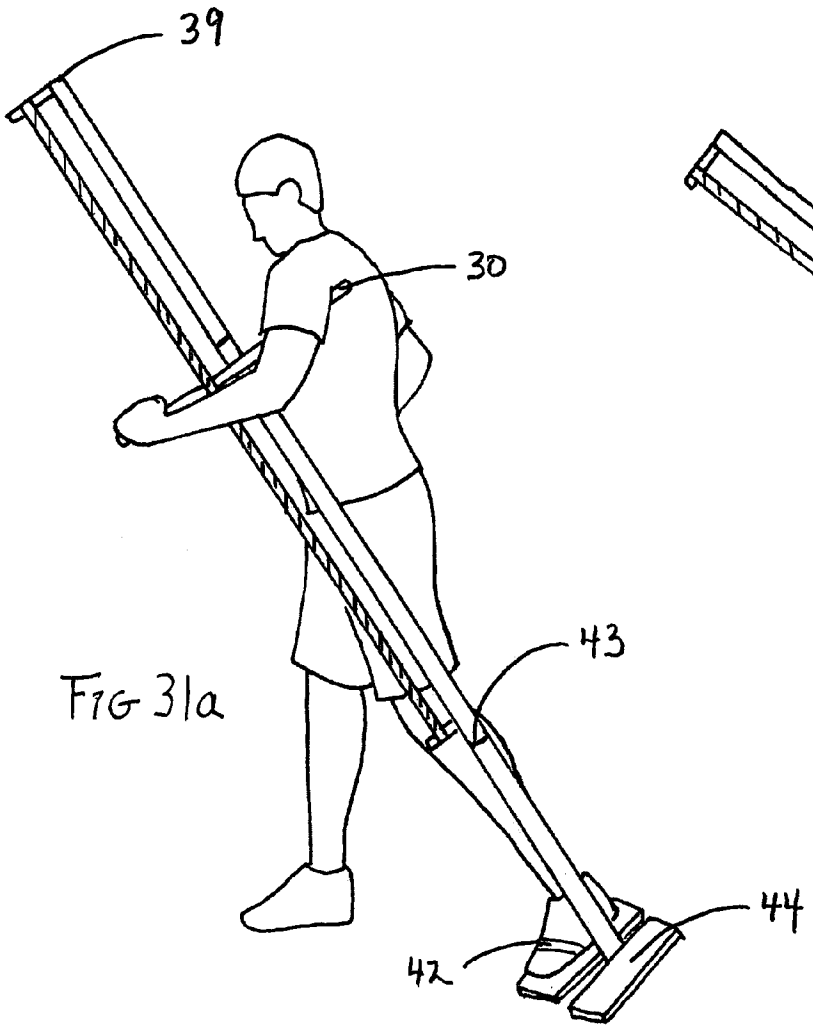

As shown in FIG. 31, the operator 52 places the exercise system 26 on the left side of the body, places the left foot in the foot holder 44R, secures the foot by tightening foot strap 42R, positions the exercise system 26 at an angle to the floor with the distal end 49 behind the operator 52, places one handle 30L or 30R under the left axilla, grasps the opposite handle 30L or 30 R, and holds the handle 30 in place, as shown in FIG. 31*a*. The operator 52 then pulls the foot boards 40 up from the floor as shown in FIG. 31 using the left leg. The exercise shown in FIG. 31 can also be performed on either side of the body and/or with the exercise system 26 placed at various angles relative to the floor.

Figure 32A:
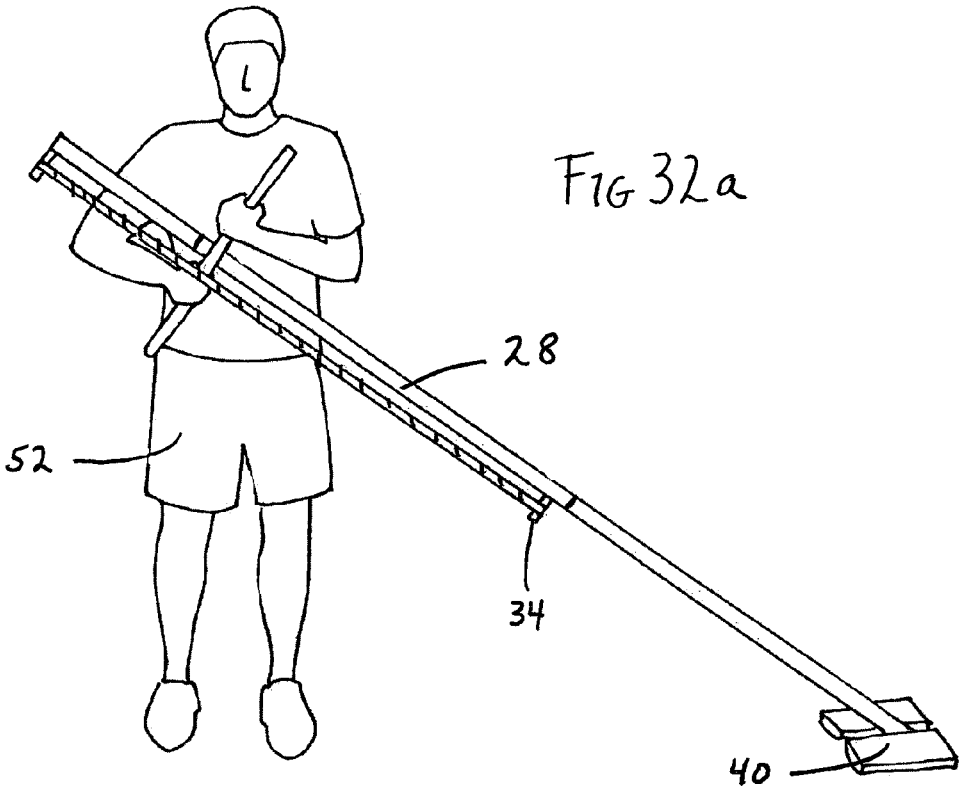
Figure 32B:
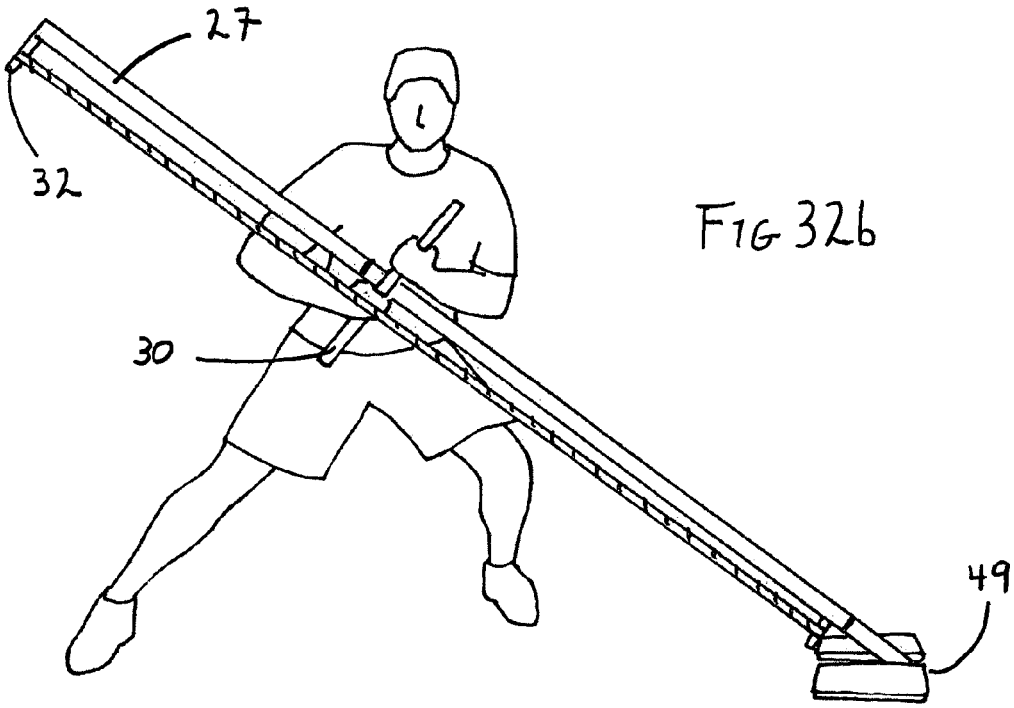

As shown in FIG. 32, the operator 52 places the exercise system 26 diagonally across the front of the body with distal end 49 to one side of the body and in contact with the floor or a solid object. Both hands of the operator 52 grasp the handle 30L and 30R with the arms bent and hold the handle 30 diagonal to the floor as shown in FIG. 32*a*. Keeping the arms bent and holding the handle 30 diagonal to the floor, the operator pulls the handle 30 downward toward the distal end 49 by bending the leg on the same side of the body as the distal end 49 and stepping toward the distal end 49 as shown in FIG. 32*b*. The exercise shown in FIG. 32 can also be performed on either side of the body and/or with the exercise system 26 placed at various angles relative to the floor.

Exercises are also performed by the operator 52 standing and using the exercise system 26 in the second configuration. At least one resistance band 54 is secured to one or more handles 30L and/or 30R and to the band anchors 36L and/or 36R. In the alternative, at least one resistance band 54 is secured to one or more handles 30L and/or 30R and the foot board tube 38. The operator the performs one or more of the following exercises as shown in FIGS. 34-37.

Figure 33B:
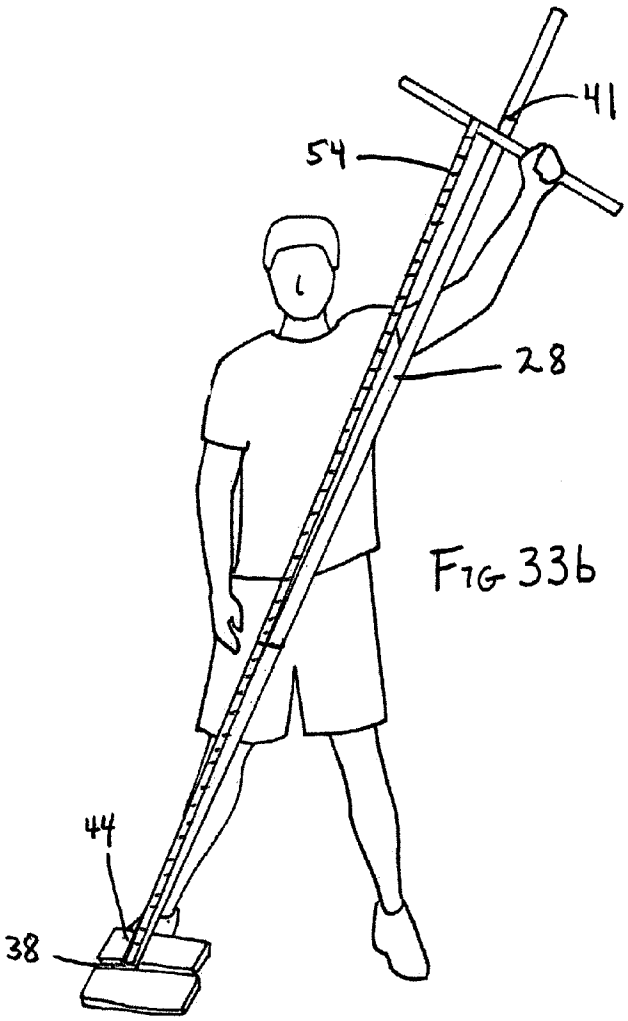
Figure 33A:
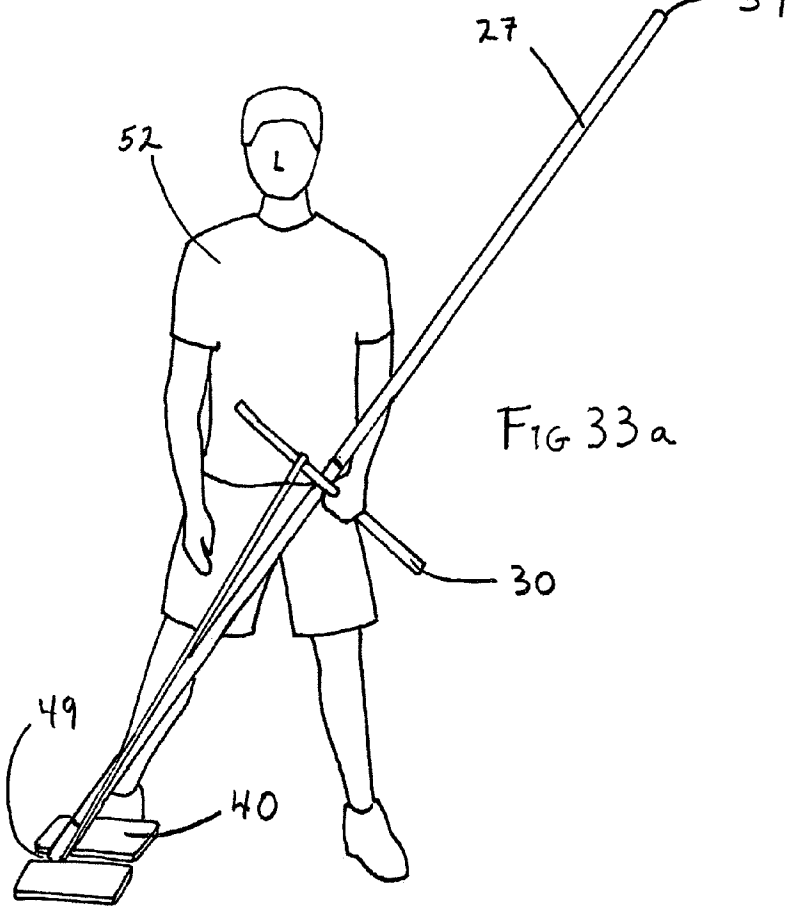

As shown in FIG. 33, the operator 52 places the exercise system 26 diagonally across the front of the body with distal end 49 to one side of the body and in contact with the floor and the foot board holders 44L and 44R and foot straps 42L and 42R facing the ground, secures the distal end 49 to the floor by standing on one of the foot straps 42L or 42R, grasps handle 30L or 30R with the hand of the opposite side of the body as the position of the distal end 49, holds the handle 30 diagonal to the floor, maintains the back in an upright position, and keeps the arms straight and extended downward, as shown in FIG. 33*a*. Keeping the back and arms straight and holding the handle 30 diagonal to the floor, the operator lifts the handle 30 upward toward the proximal end 39 by raising the straight arm of the hand holding the handle 30 until the hand is above the head, as shown in FIG. 33*b*. The exercise shown in FIG. 33 can also be performed on either side of the body and/or with the exercise system 26 placed at various angles relative to the floor.

Figure 34B:
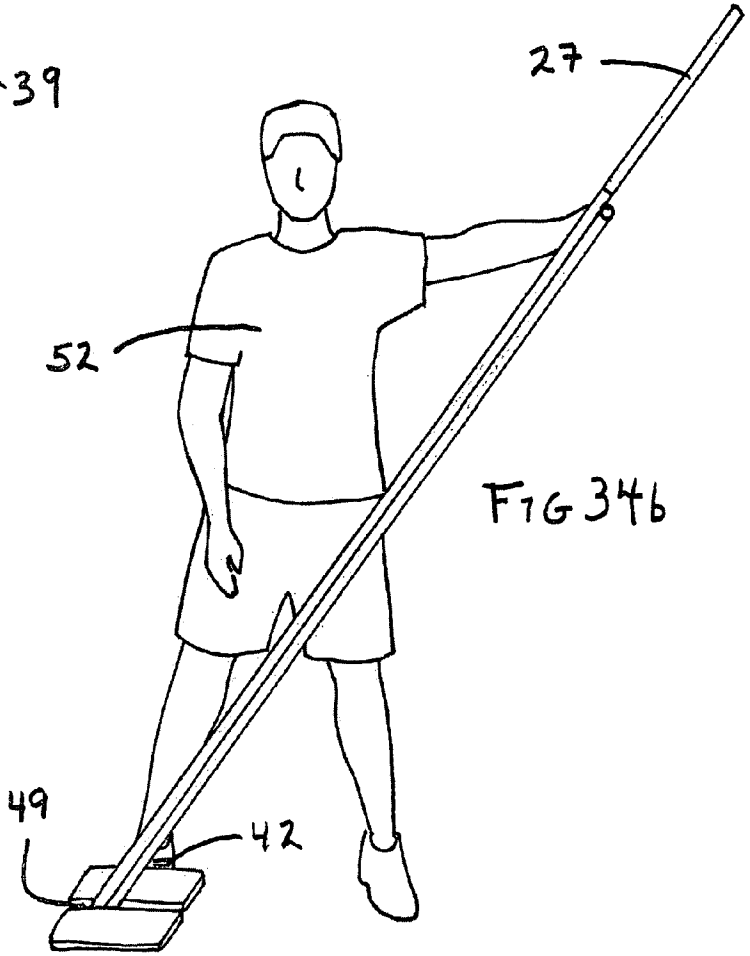
Figure 34A:
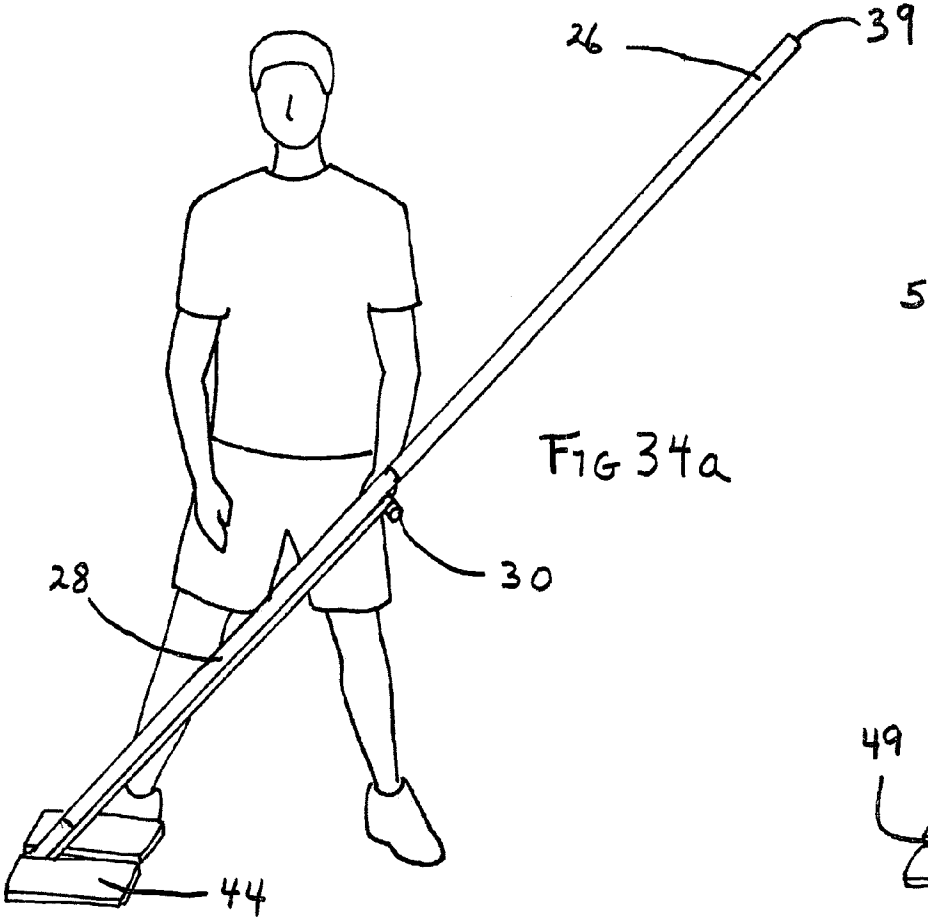

As shown in FIG. 34, the operator 52 places the exercise system 26 diagonally across the front of the body with distal end 49 to one side of the body and in contact with the floor and the foot board holders 44L and 44R and foot straps 42L and 42R facing the ground, secures the distal end 49 to the floor by standing on one of the foot straps 42L or 42R, grasps handle 30L or 30R with the hand on the opposite side of the body as the distal end 49, holds the handle 30 parallel to the floor, and maintains the back in an upright position, and keeps the arms straight and extended downward, as shown in FIG. 34*a*. Keeping the back and arms straight and holding the handle 30 parallel to the floor, the operator 52 lifts the handle 30 upward toward the proximal end 39 by raising the straight arm of the hand holding the handle 30 until the hand is at the level of the head, as shown in FIG. 34*b*. The exercise shown in FIG. 34 can also be performed on either side of the body and/or with the exercise system 26 placed at various angles relative to the floor.

Figure 35B:
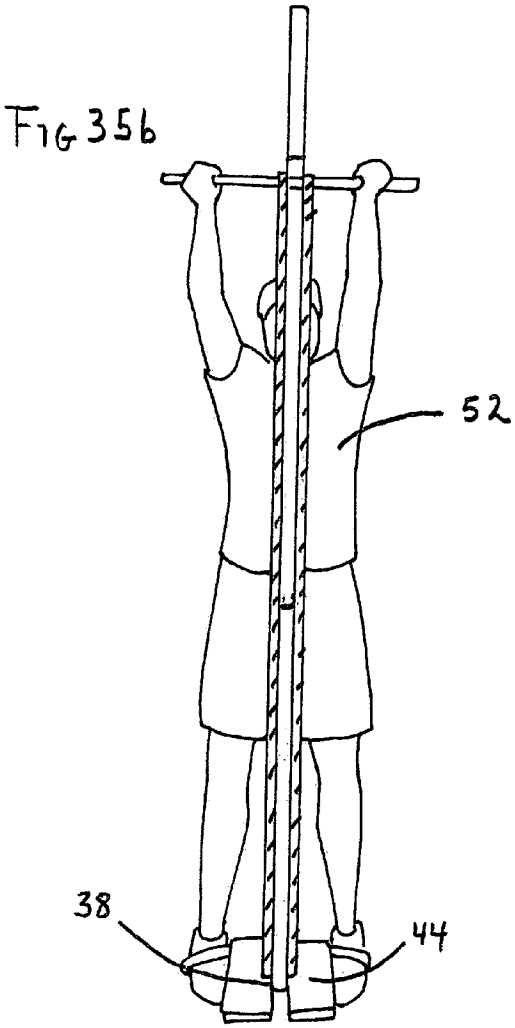
Figure 35A:
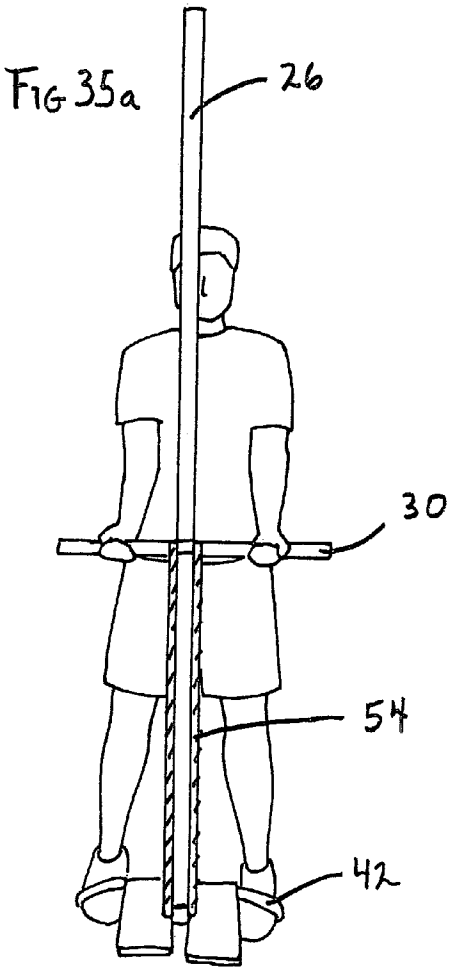

As shown in FIG. 35, the operator 52 places the exercise system 26 in front of the body, positions the distal end 49 between the feet and the exercise system 26 in a vertical orientation with the proximal end 39 directed upward and the distal end 49 in contact with the floor and the foot board holders 44L and 44R and foot straps 42L and 42R facing the floor, secures the distal end 49 to the floor by standing on the foot straps 42L and 42R, grasps handle 30L and 30R, holds the handle 30 parallel to the floor, maintains the back in an upright position, and keeps the arms straight and extended downward with the handle 30 positioned at arm length away from the body, as shown in FIG. 35*a*. Keeping the back and arms straight and holding the handle 30 parallel to the floor, the operator lifts the handle 30 upward toward the proximal end 39 by raising the arms until the hands are above the head, as shown in FIG. 35*b*.

Figure 36B:
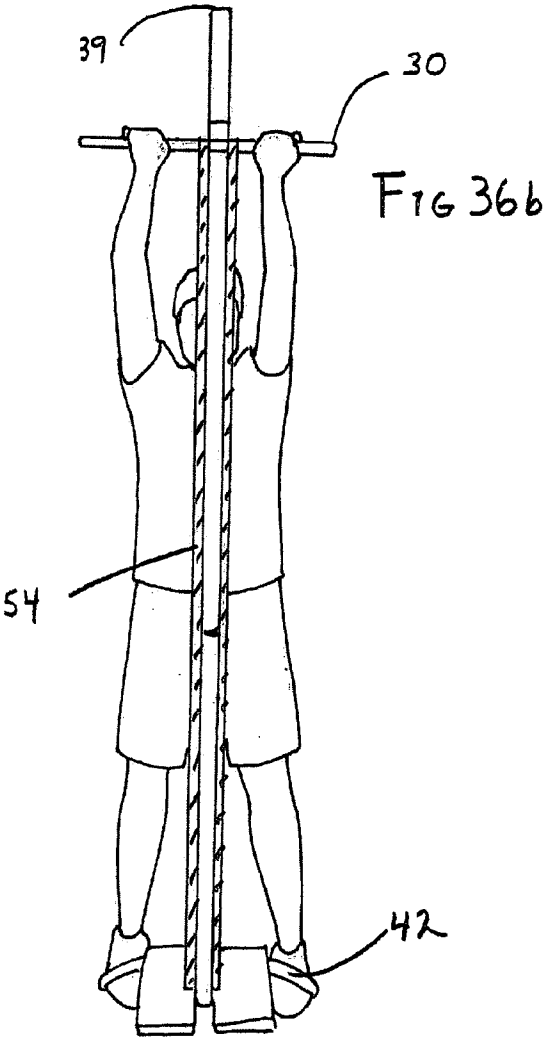
Figure 36A:
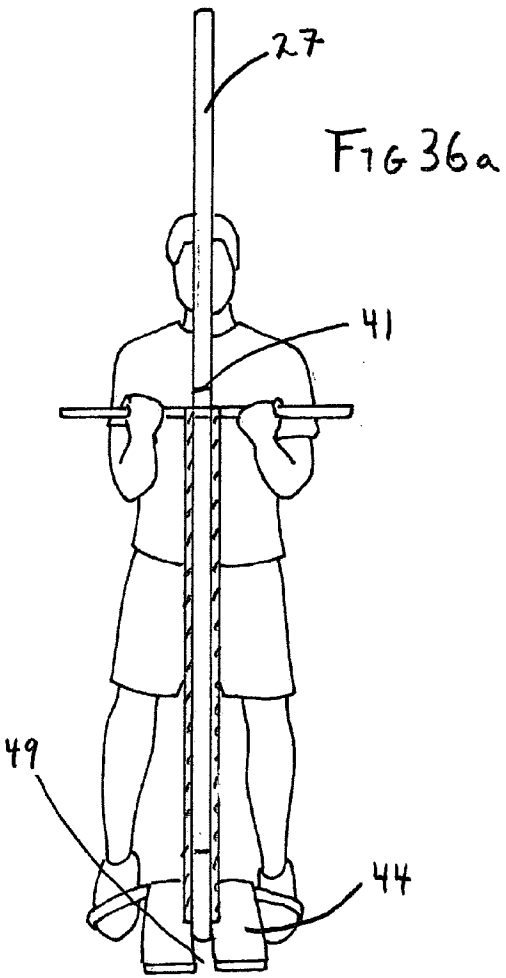
Figure 36D:
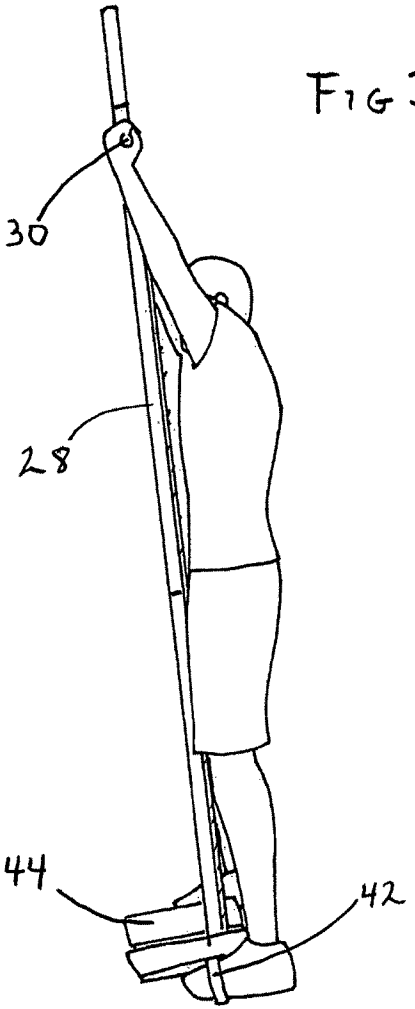
Figure 36C:
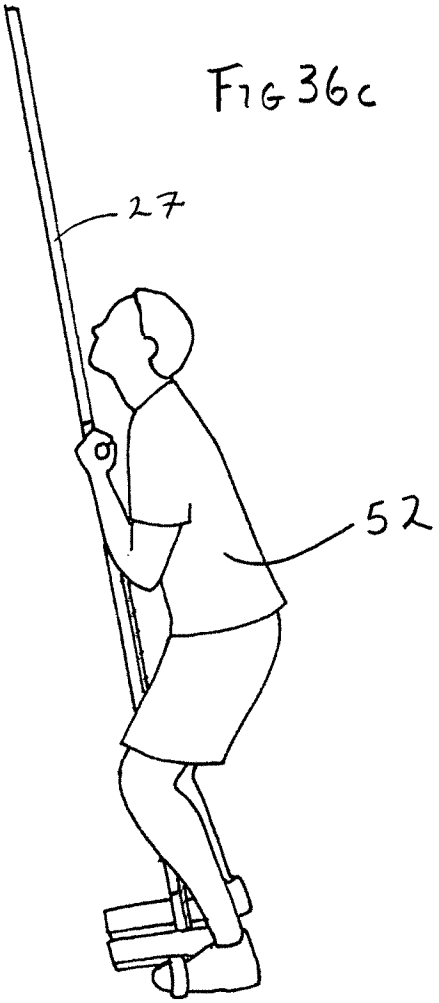

As shown in FIG. 36, the operator 52 places the exercise system 26 in front of the body, positions the distal end 49 between the feet and the exercise system 26 in a vertical orientation with the proximal end 39 directed upward and the distal end 49 in contact with the floor and the foot board holders 44L and 44R and foot straps 42L and 42R facing the floor, secures the distal end 49 to the floor by standing on the foot straps 42L and 42R, grasps handle 30L and 30R, holds the handle 30 parallel to the floor, maintains the back in an upright position, bends the legs at the knees, and bends the arms at the elbow, with the handle 30 positioned in contact with or close to the body at the level of the chest, as shown in FIGS. 36*a* and 36*c*. Keeping the back straight and holding the handle 30 parallel to the floor, the operator lifts the handle 30 upward toward the proximal end 39 by simultaneously straightening the legs and arms, raising the arms until the hands are above the head, as shown in FIGS. 36*b* and 36*d*.

Exercises are also performed by the operator 52 lying supine and using the exercise system 26 in the second configuration. At least one resistance band 54 is secured to one or more handles 30L and/or 30R and to the band anchors 36L and/or 36R. In the alternative, at least one resistance band 54 is secured to one or more handles 30L and/or 30R and the foot board tube 38. The operator the performs one or more of the following exercises as shown in FIG. 37.

Figure 37A:
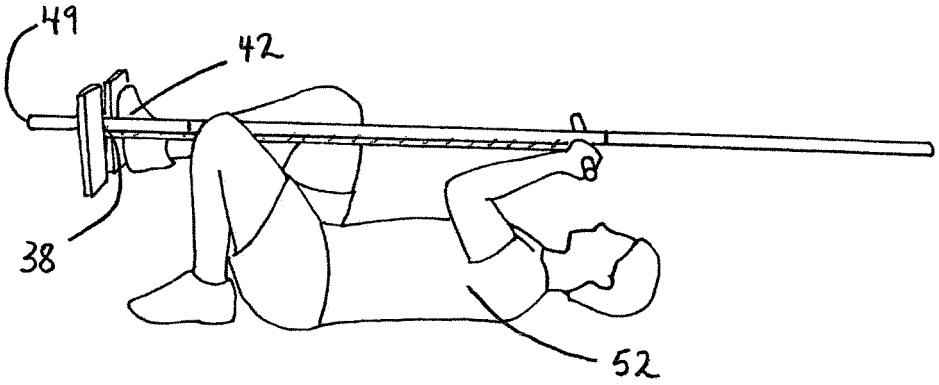
Figure 37B:
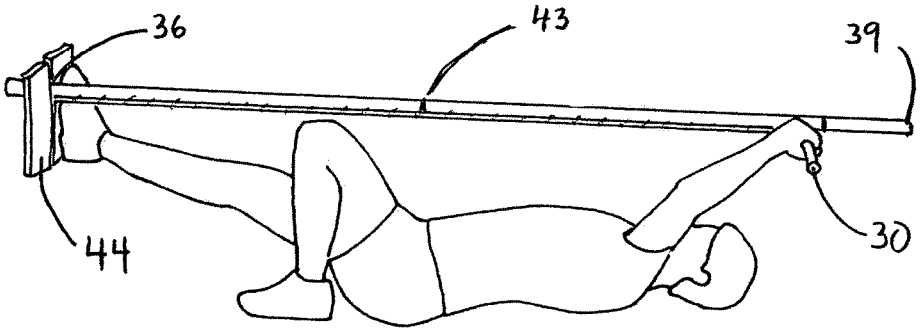

As shown in FIG. 37, the operator 52 places the exercise system over the front of the body, places the right foot into foot holder 44R, secures the foot by tightening foot strap 42R, grasps handle 30L and with the left hand, and raises the handle 30 to about the level of the face, as shown in FIG. 37*a*. The operator 52 simultaneously pushes the handle 30 toward the proximal end 39 using the left arm and pushes the foot boards 40 toward the distal end 49 using the right leg, as shown in FIG. 37*b*. The exercise shown in FIG. 37 can also be performed using the left foot and leg and the right hand and arm.

It will be appreciated by those skilled in the art that changes could be made to the embodiments described above without departing from the broad inventive concept thereof. It is understood, therefore, that the invention disclosed herein is not limited to the particular embodiments disclosed, but it is intended to cover modifications within the spirit and scope of the present invention as defined by the appended claims.

The invention claimed is:

1. A method of using an exercise device for physical exercise of the body comprising the steps of:

(a) providing an apparatus comprising:

an elongated member comprising:

a first length; and a head end at one end of the first length; and a foot board end at the opposite end of the first length; and the foot board end comprising the distal end of the apparatus; and the head end comprising the proximal end of the apparatus; and a hollow member comprising:

a second length; and a handle end at one end of the second length; and a feet end at the opposite end of the second length; and the elongated member being positioned within the hollow member; and the handle end of the hollow member being positioned at the proximal end of the apparatus; and the elongated member and the hollow member being slidably moveable relative to each other; and a handle system comprising:

a handle clamp attached to the handle end of the hollow member; and a pair of handles affixed to the handle clamp, wherein the handles extend outwardly from the hollow member; and a foot board system comprising:

a foot board tube attached to the foot board end of the elongated member, wherein the foot board tube extends outwardly therefrom; and a pair of foot straps; and a pair of foot holders; and a pair of foot boards, wherein the foot boards are attached to the foot board tube, and a foot strap and a foot holder are affixed to a foot board; and an end cap, wherein the end cap is attached to a distal tip of the foot board end of the elongated member; and a plurality of securing locations comprising:

a handle; and a band anchor attached to the feet end of the hollow member; and a band anchor attached to the head end of the elongated member; and a band anchor attached to the foot board tube; and a resistance band comprising:

a first end; and a second end; and (b) configuring the apparatus by:

securing the first end of the resistance band to a securing location on the elongated member; and securing the second end of the resistance band to a securing locations on the hollow member; and (c) positioning the apparatus by:

securing the distal end; and grasping a handle with a hand; and (d) performing exercise of the body by:

moving the distal end relative to the proximal end using an extremity.

2. The method of claim 1 wherein:

the configuring step further comprises:

arranging the apparatus in a first configuration, wherein the first end of the resistance band is secured to a securing location on the head end of the elongated member, and the second end of the resistance band is secured to a securing location on the feet end of the hollow member; and the positioning step further comprises:

securing a foot into the foot board system; and lying supine on a floor; and resting the apparatus on the abdomen; and grasping a handle with a hand, straightening the legs; and raising the hands over the head; and straightening the arms; and the performing step further comprises:

pulling the foot board system toward the proximal end using a leg; and simultaneously holding a handle in place using an arm.

3. The method of claim 1 wherein:

the configuring step further comprises:

arranging the apparatus in a first configuration, wherein the first end of the resistance band is secured to a securing location on the head end of the elongated member, and the second end of the resistance band is secured to a securing location on the feet end of the hollow member; and the positioning step further comprises:

securing a foot into the foot board system; and lying supine on a floor; and resting the apparatus on the abdomen; and grasping a handle with a hand, straightening the leg of the foot; and raising the hand over the head; and straightening the arm of the hand; and the performing step further comprises:

pulling the foot board system toward the proximal end using the leg; and simultaneously pulling the handle toward the distal end using the arm.

4. The method of claim 1 wherein:

the configuring step further comprises:

arranging the apparatus in a first configuration, wherein the first end of the resistance band is secured to a securing location on the head end of the elongated member, and the second end the resistance band is secured to a securing location on the feet end of the hollow member; and the positioning step further comprises:

securing the foot of one leg into the foot board system; and lying supine on a floor; and resting the apparatus on the abdomen; and grasping a handle with the hand of the arm opposite the one leg; and bending the one leg; and raising the hand of the arm over the head; and straightening the arm; and the performing step further comprises:

pulling the handle toward the distal end using the arm; and simultaneously holding the foot board system in place using the one leg.

5. The method of claim 1 wherein:

the configuring step further comprises:

arranging the apparatus in a first configuration, wherein the first end of the resistance band is secured to a securing location on the head end of the elongated member, and the second end of the resistance band is secured to a securing location on the feet end of the hollow member; and the positioning step further comprises:

securing the foot of one leg into the foot board system; and lying supine on a floor; and resting the apparatus on the abdomen; and grasping the handle with the hand of the arm opposite the one leg; and straightening the one leg; and raising the hand of the arm over the head; and straightening the arm; and the performing step further comprises:

pulling the handle toward the distal end using the arm; and simultaneously pulling the foot board system toward the proximal end using the one leg.

6. The method of claim 1 wherein:

the configuring step further comprises:

arranging the apparatus in a first configuration, wherein the first end of the resistance band is secured to a securing location on the head end of the elongated member, and the second end of the resistance band is secured to a securing location on the feet end of the hollow member; and the positioning step further comprises:

securing the foot of one leg into the foot board system; and lying supine on a floor; and resting the apparatus on the abdomen; and grasping a handle with the hand of the arm opposite the one leg; and straightening the one leg; and raising the hand of the arm over the head; and straightening the arm; and the performing step further comprises:

holding the handle in place using the arm, and simultaneously pulling the foot board system toward the proximal end using the one leg.

7. The method of claim 1 wherein:

the configuring step further comprises:

arranging the apparatus in a first configuration, wherein the first end of the resistance band is secured to a securing location on the head end of the elongated member, and the second end of the resistance band is secured to a securing location on the feet end of the hollow member; and the positioning step further comprises:

securing a foot into the foot board system; and lying supine on a floor; and resting the apparatus on the abdomen; and grasping a handle with a hand; and bending the legs; and raising the hands over the head; and straightening the arms; and the performing step further comprises:

pulling the foot board system toward the proximal end using the ankle of the foot; and and simultaneously holding the handle in place using the arm.

8. The method of claim 1 wherein:

the configuring step further comprises:

arranging the apparatus in a first configuration, wherein the first end of the resistance band is secured to a securing location on the head end of the elongated member, and the second end of the resistance band is secured to a securing location on the feet end of the hollow member; and the positioning step further comprises:

securing a foot into the foot board system; and lying supine on a floor; and resting the apparatus on the abdomen; and grasping a handle with a hand; and bending the leg of the foot to push the foot board toward the distal end so that the distal tip of the foot board end is in contact with the floor; and bending the arm so that the hand of the arm is at about the level of the chest; and the performing step further comprises:

holding the foot board system in place and the distal tip of the foot board end in contact with the floor using the leg; and simultaneously pulling the handle toward the distal end using the arm.

9. The method of claim 1 wherein:

the configuring step further comprises:

arranging the apparatus in a first configuration, wherein the first end of the resistance band is secured to a securing location on the head end of the elongated member, and the second end of the resistance band is secured to a securing location on the feet end of the hollow member; and the positioning step further comprises:

securing a foot into the foot board system; and lying prone on a floor; and resting the apparatus on the back; and grasping one handle with both hands; and straightening the leg of the foot; and raising the hands over the head; and straightening the arms; and the performing step further comprises:

pulling the foot board system toward the proximal end using the leg; and simultaneously holding the handles in place using the arms.

10. The method of claim 1 wherein:

the configuring step further comprises:

arranging the apparatus in a first configuration, wherein the first end of the resistance band is secured to a securing location on the head end of the elongated member, and the second end of the resistance band is secured to a securing location on the feet end of the hollow member; and the positioning step further comprises:

placing the apparatus between the legs at an angle to a floor so that the distal tip of the foot board end is in contact with the floor and the proximal end is at about the level of the head; and grasping a handle with a hand; and standing and straightening the back; and raising the hand toward the proximal end; and straightening the arm of the hand; and the performing step further comprises:

pulling the handle toward the distal end using the arm by bending it at the shoulder while maintaining the back straight and the arm straight at the elbow; and simultaneously holding the foot board system in place and the distal tip of the foot board end in contact with the floor.

11. The method of claim 1 wherein:

the configuring step further comprises:

arranging the apparatus in a first configuration, wherein the first end of the resistance band is secured to a securing location on the head end of the elongated member, and the second end of the resistance band is secured to a securing location on the feet end of the hollow member; and the positioning step further comprises:

placing the apparatus between the legs with the distal tip of the foot board end in contact with a floor and the proximal end at about the level of the head; and grasping a handle with a hand; and maintaining the legs and back in a squatting position; and raising the hand toward the proximal end; and straightening the arm of the hand; and the performing step further comprises:

pulling the handle toward the distal end using the arm by bending it at the elbow; and simultaneously holding the distal tip of the foot board end in contact with the floor.

12. The method of claim 1 wherein:

the configuring step further comprises:

arranging the apparatus in a first configuration, wherein the first end of the resistance band is secured to a securing location on the head end of the elongated member, and the second end of the resistance band is secured to a securing location on the feet end of the hollow member; and the positioning step further comprises placing the apparatus diagonally across the front of the body so that the distal tip of the foot board end is in contact with a floor toward one side of the body and the proximal end is at about the level of the head toward the opposite side of the body; and grasping the handles with the hands; and standing and maintaining the back in an upright position; and raising the hands toward the proximal end; and straightening the arms; and the performing step further comprises:

pulling the handles downward diagonally across the front of the body toward the distal end using the arms; and simultaneously holding the distal tip of the foot board end in contact with the floor.

13. The method of claim 1 wherein:

the configuring step further comprises:

arranging the apparatus in a first configuration, wherein the first end of the resistance band is secured to a securing location on the head end of the elongated member, and the second end of the resistance band is secured to a securing location on the feet end of the hollow member; and the positioning step further comprises:

placing the apparatus between the legs with the distal tip of the foot board end in contact with a floor and the proximal end above the level of the head; and grasping a handle with a hand; and standing and maintaining the back in an upright position; and raising the hand toward the proximal end; and straightening the arm of the hand; and the performing step further comprises:

pulling the handle toward the distal end using the arm by bending it at the elbow and using the legs to squat downward by bending the legs at the hip and the knees while holding the back in an upright position; and simultaneously holding the distal tip of the foot board end in contact with the floor.

14. The method of claim 1 wherein:

the configuring step further comprises:

arranging the apparatus in a first configuration, wherein the first end of the resistance band is secured to a securing location on the head end of the elongated member, and the second end of the resistance band is secured to a securing location on the feet end of the hollow member; and the positioning step further comprises:

placing the apparatus between the legs with the distal tip of the foot board end in contact with a floor and the proximal end above the level of the head; and grasping a handle with a hand; and standing and maintaining the back in an upright position; and raising the hand toward the proximal end; and straightening the arm of the hand; and the performing step further comprises:

pulling the handle toward said distal end using the legs to squat downward by bending the legs at the hip and the knees; and keeping the arm straight; and simultaneously holding the distal tip of the foot board end in contact with the floor.

15. The method of claim 1 wherein:

the configuring step further comprises:

arranging the apparatus in a first configuration, wherein the first end of the resistance band is secured to a securing location on the head end of the elongated member, and the second end of the resistance band is secured to a securing location on the feet end of the hollow member; and the positioning step further comprises:

placing the apparatus between the legs with the distal tip of the foot board end in contact with a floor and the proximal end above the level of the head; and grasping a handle with a hand; and squatting downward by bending the legs at the hip and the knees; and raising the hand toward the proximal end; and straightening the arm of the hand; and the performing step further comprises:

pulling the handle toward said distal end using the arm by bending it at the elbow; and maintaining a squatting position by holding the legs bent at the hip and the knees; and simultaneously holding the distal tip of the foot board end in contact with the floor.

16. The method of claim 1 wherein:

the configuring step further comprises:

arranging the apparatus in a first configuration, wherein the first end of the resistance band is secured to a securing location on the head end of the elongated member, and the second end of the resistance band is secured to a securing location on the feet end of the hollow member; and the positioning step further comprises:

placing the apparatus alongside one side of the body with the distal tip of the foot board end in contact with a floor and the proximal end at about the level of the head; and securing one foot into the foot board system; and grasping the handles with the hands; and standing and maintaining the back in an upright position; and raising the hands toward the proximal end; and straightening the arms; and the performing step further comprises:

pulling the handles toward the distal end using the arms; and simultaneously holding the distal tip of the foot board end in contact with the floor.

17. The method of claim 1 wherein:

the configuring step further comprises:

arranging the apparatus in a first configuration, wherein the first end of the resistance band is secured to a securing location on the head end of the elongated member, and the second end of the resistance band is secured to a securing location on the feet end of the hollow member; and the positioning step further comprises:

placing the apparatus alongside one side of the body with the distal tip of the foot board end in contact with a floor and the proximal end at about the level of the head; and securing one foot into the foot board system; and grasping the handles with the hands; and standing and maintaining the back in an upright position; and raising the hands toward the proximal end; and
straightening the arms; and
the performing step further comprises:
pulling the handles toward the distal end using the arms; and
pulling the foot board end off the floor toward the proximal end using the leg of the one foot.

18. The method of claim 1 wherein:
the configuring step further comprises:
arranging the apparatus in a first configuration, wherein the first end of the resistance band is secured to a securing location on the head end of the elongated member, and the second end of the resistance band is secured to a securing location on the feet end of the hollow member; and
the positioning step further comprises:
placing the apparatus alongside one side of the body with the distal tip of the foot board end in contact with a floor and the proximal end at about the level of the head; and
securing one foot into the foot board system; and
grasping the handles with the hands; and
standing and maintaining the back in an upright position; and
raising the hands toward the proximal end; and
straightening the arms; and
the performing step further comprises:
pulling the foot board end off the floor toward the proximal end using the leg of the one foot; and
simultaneously holding the handles in place using the arms.

19. The method of claim 1 wherein:
the configuring step further comprises:
arranging the apparatus in a first configuration, wherein the first end of the resistance band is secured to a securing location on the head end of the elongated member, and the second end of the resistance band is secured to a securing location on the feet end of the hollow member; and
the positioning step further comprises:
placing the apparatus in front of the body with the distal tip of the foot board end in contact with a floor directly in front of the body and the proximal end in contact with the chest; and
grasping the handles with the hands; and
standing and maintaining the back in an upright position; and
bending the arms; and
the performing step further comprises:
pushing the handles downward in front of the body toward the distal end using the arms; and
simultaneously holding the distal tip of the foot board end in contact with the floor.

20. The method of claim 1 wherein:
the configuring step further comprises:
arranging the apparatus in a second configuration, wherein the first end of the resistance band is secured to a securing location on the foot board end of the elongated member, and the second end of the resistance band is secured to a securing location on the handle end of the hollow member; and
the positioning step further comprises:
securing a foot into the foot board system; and
lying supine on a floor; and
resting the apparatus on the abdomen; and
grasping a handle with a hand; and
bending the legs; and
bending the arm of the hand so that the hand is at about the level of the chest; and
the performing step further comprises:
pushing the foot board system toward the distal end using the leg of the foot; and
simultaneously holding the handles in place using the arm.

21. The method of claim 1 wherein:
the configuring step further comprises:
arranging the apparatus in a second configuration, wherein the first end of the resistance band is secured to a securing location on the foot board end of the elongated member, and the second end of the resistance band is secured to a securing location on the handle end of the hollow member; and
the positioning step further comprises:
securing a foot into the foot board system; and
lying supine on a floor; and
resting the apparatus on the abdomen; and
grasping a handle with a hand; and
bending the leg and
bending the arm of the hand so that the hand is at about the level of the chest; and
the performing step further comprises:
pushing the foot board system toward the distal end using the leg; and
simultaneously pushing the handle toward the proximal end using the arm.

22. The method of claim 1 wherein:
the configuring step further comprises:
arranging the apparatus in a second configuration, wherein the first end of the resistance band is secured to a securing location on the foot board end of the elongated member, and the second end of the resistance band is secured to a securing location on the handle end of the hollow member; and
the positioning step further comprises:
securing a foot into the foot board system; and
lying supine on a floor; and
resting the apparatus on the abdomen; and
grasping a handle with a hand; and
bending the leg of the foot; and
bending the arm of the hand so that the hand is at about the level of the chest; and
the performing step further comprises:
pushing the handle toward the proximal end using the arm; and
simultaneously holding the foot board system in place using the leg.

23. The method of claim 1 wherein:
the configuring step further comprises:
arranging the apparatus in a second configuration, wherein the first end of the resistance band is secured to a securing location on the foot board end of the elongated member, and the second end of the resistance band is secured to a securing location on the handle end of the hollow member; and
the positioning step further comprises:
securing a foot into the foot board system; and
lying supine on a floor; and
resting the apparatus on the abdomen; and
grasping a handle with a hand; and
bending the leg of the foot to push the foot board toward the distal end so that the distal tip of the foot board end is in contact with the floor; and
bending the arm of the hand so that the hand is at about the level of the chest; and the performing step further comprises:

pushing the handle toward the proximal end using the arm; and simultaneously holding the foot board system in place and the distal tip of the foot board end in contact with the floor.

24. The method of claim 1 wherein:

the configuring step further comprises:

arranging the apparatus in a first configuration, wherein the first end of the resistance band is secured to a securing location on the head end of the elongated member, and the second end of the resistance band is secured to a securing location on the feet end of the hollow member; and the positioning step further comprises:

placing the apparatus diagonally across the front of the body with the distal tip of the foot board end in contact with a floor toward one side of the body and the proximal end at about the level of the head toward the opposite side of the body; and grasping a handle with one hand; and standing and maintaining the back in an upright position; and raising the hand toward said proximal end; and straightening the arm of the hand; and holding the handle in a diagonal orientation to said floor; and the performing step further comprises:

pulling the handle downward diagonally across the front of the body toward the distal end and moving the handle away from the front of the body using the straight arm; and simultaneously holding the distal tip of the foot board end in contact with the floor.

25. The method of claim 1 wherein:

the configuring step further comprises:

arranging the apparatus in a first configuration, wherein the first end of the resistance band is secured to a securing location on the head end of the elongated member, and the second end of the resistance band is secured to a securing location on the feet end of the hollow member; and the positioning step further comprises:

placing the apparatus diagonally across the front of the body with the distal tip of the foot board end in contact with a floor toward one side of the body and the proximal end at about the level of the head toward the opposite side of the body; and grasping a handle with one hand; and standing and maintaining the back in an upright position; and straightening the arm of the hand; and holding the handle in a parallel orientation to the floor; and raising the arm until it is parallel to the floor and until the elongated member and the hollow tube are touching the body; and the performing step further comprises:

pulling the handle downward toward the distal end and toward the waist using the straight arm; and simultaneously holding the distal tip of the foot board end in contact with the floor.

26. The method of claim 1 wherein:

the configuring step further comprises:

arranging the apparatus in a first configuration, wherein the first end of the resistance band is secured to a securing location on the head end of the elongated member, and the second end of the resistance band is secured to a securing location on the feet end of the hollow member; and the positioning step further comprises:

placing the apparatus upright in front of the body with the distal end between the legs and the distal tip of the foot board end in contact with the floor and a foot in contact with a foot board tube and the proximal end above the head; and grasping the handle with a hand; and standing and straightening the back; and raising the hand toward the proximal end; and straightening the arm of the hand, and holding the handle over the head; and the performing step further comprises:

pulling the handles toward the distal end using the arm by bending at the shoulder while maintaining the back straight and the arm straight at the elbow; and simultaneously holding the foot board system in place and the distal tip of the foot board end in contact with the floor.

27. The method of claim 1 wherein:

the configuring step further comprises:

arranging the apparatus in a first configuration, wherein the first end of the resistance band is secured to a securing location on the head end of the elongated member, and the second end of the resistance band is secured to a securing location on the feet end of the hollow member; and the positioning step further comprises:

placing the apparatus at an angle to a floor alongside one side of the body with the distal tip of the foot board end in contact with the floor and the proximal end at about the level of the head; and standing facing the distal end and maintaining the back in an upright position; and grasping the handle with a hand and holding the handle diagonal to the floor; and bending the arm of the hand; and holding the handle at about the level of the shoulder with the proximal end close to the body; and the performing step further comprises:

pushing the handle toward the distal end using the arm; and simultaneously holding the distal tip of the foot board end in contact with the floor.

28. The method of claim 1 wherein:

the configuring step further comprises:

arranging the apparatus in a first configuration, wherein the first end of the resistance band is secured to a securing location on the head end of the elongated member, and the second end of the resistance band is secured to a securing location on the feet end of the hollow member; and the positioning step further comprises:

placing the apparatus at an angle to a floor alongside one side of the body with the distal tip of the foot board end in contact with the floor and the proximal end at about the level of the head; and standing facing the distal end and maintaining the back in an upright position; and grasping a handle with a hand and holding the handle diagonal to the floor; and straightening the arm of the hand; and holding the handle at about the level of the shoulder with the proximal end about an arm length away from the body; and the performing step further comprises:

pushing the handle toward the distal end and the proximal end toward the body using the straight arm; and simultaneously holding the distal tip of the foot board end in contact with the floor.

29. The method of claim 1 wherein:

the configuring step further comprises:

arranging the apparatus in a first configuration, wherein the first end of the resistance band is secured to a securing location on the head end of the elongated member, and the second end of the resistance band is secured to a securing location on the feet end of the hollow member; and the positioning step further comprises:

placing the apparatus at an angle to a floor alongside one side of the body with the distal tip of the foot board end in contact with the floor and the proximal end at about the level of the head; and securing one foot into the foot board system with the distal tip at the outside of the foot and the distal end behind the body; and placing a handle under the axilla on the same side of the body as the foot; and grasping the handle with the hand on the same side of the body as the axilla and the foot; and standing and maintaining the back in an upright position; and holding the handle at about the level of the chest; and the performing step further comprises:

pulling the foot board end off the floor toward the proximal end using the leg of the foot; and simultaneously holding the handle in place using the arm and the axilla.

30. The method of claim 1 wherein:

the configuring step further comprises:

arranging the apparatus in a first configuration, wherein the first end of the resistance band is secured to a securing location on the head end of the elongated member, and the second end of the resistance band is secured to a securing location on the feet end of the hollow member; and the positioning step further comprises:

placing the apparatus diagonally across the front of the body with the distal tip of the foot board end in contact with a floor toward one side of the body and the proximal end at about the level of the shoulder toward the opposite side of the body; and grasping the handles with both hands; and standing with the legs straight; and maintaining the back in an upright position; and bending the arms; and holding the handles at about the level of the chest in a diagonal orientation to the floor; and the performing step further comprises:

pulling the handles downward toward the distal end and toward the floor by bending the leg on the same side of the body as the distal end and stepping toward the distal end while keeping the arms bent and holding the handles in a diagonal orientation to the floor; and simultaneously holding the distal tip of the foot board end in contact with the floor.

31. The method of claim 1 wherein:

the configuring step further comprises:

arranging the apparatus in a second configuration, wherein the first end of the resistance band is secured to a securing location on the foot board end of the elongated member, and the second end of the resistance band is secured to a securing location on the handle end of the hollow member; and the positioning step further comprises:

placing the apparatus diagonally across the front of the body with the distal tip of the foot board end in contact with a floor toward one side of the body and the proximal end above the level of the head toward the opposite side of the body with the foot board holders and said foot straps facing the floor; and securing the distal end to the floor by standing on a foot strap with the foot on the one side of the body; and grasping one handle with the hand on the opposite side of the body; and standing with the legs straight; and maintaining the back in an upright position; and straightening the arm of the hand grasping the handle; and holding the handle in a diagonal orientation to the floor; and the performing step further comprises:

pulling the handle upward across the front of the body toward the proximal end while holding the handle in a diagonal orientation to the floor; and simultaneously holding the distal tip of the foot board end in contact with the floor.

32. The method of claim 1 wherein:

the configuring step further comprises:

arranging the apparatus in a second configuration, wherein the first end of the resistance band is secured to a securing location on the foot board end of the elongated member, and the second end of the resistance band is secured to a securing location on the handle end of the hollow member; and the positioning step further comprises:

placing the apparatus diagonally across the front of the body with the distal tip of the foot board end in contact with a floor toward one side of the body and the proximal end above the level of the shoulder toward the opposite side of the body with the foot board holders and the foot straps facing the floor; and securing the distal end to the floor by standing on a foot strap; and grasping a handle with the hand on the side of the body opposite the one side of the body; and standing with the legs straight; and maintaining the back in an upright position; and straightening the arm of the hand; and holding the handle in a parallel orientation to the floor; and the performing step further comprises:

pulling the handle upward across the front of the body toward the proximal end while holding the handle in a parallel orientation to the floor; and simultaneously holding the distal tip of the foot board end in contact with the floor.

33. The method of claim 1 wherein:

the configuring step further comprises:

arranging the apparatus in a second configuration, wherein the first end of the resistance band is secured to a securing location on the foot board end of the elongated member, and the second end of the resistance band is secured to a securing location on the handle end of the hollow member; and the positioning step further comprises:

placing the apparatus upright in front of the body with the proximal end above the head and the distal end between the legs and the distal tip of said foot board end in contact with a floor and the foot board holders and the foot straps facing the floor, securing the distal end to the floor by standing on a foot strap; and grasping a handle with a hand; and standing and straightening the back; and bending the arm of the hand; and holding the handle parallel to the floor at about the level of the waist and about an arm length away from the front of the body; and the performing step further comprises:

pulling the handle upward in front of the body toward the proximal end using the arm while maintaining the back straight; and simultaneously holding the foot board system in place and the distal tip of the foot board end in contact with the floor.

34. The method of claim 1 wherein:

the configuring step further comprises:

arranging the apparatus in a second configuration, wherein the first end of the resistance band is secured to a securing location on the foot board end of the elongated member, and the second end of the resistance band is secured to a securing location on the handle end of the hollow member; and the positioning step further comprises:

placing the apparatus upright in front of the body with the proximal end above the head and the distal end between the legs and the distal tip of the foot board end in contact with a floor and the foot board holders and the foot straps facing the floor; and securing the distal end to the floor by standing on a foot strap; and grasping a handle with a hand; and standing and straightening the back; and bending the knees; and bending the arm of the hand; and holding the handle parallel to the floor at about the level of the chest with the proximal end close to the body; and the performing step further comprises:

pulling the handle upward in front of the body toward the proximal end using the arm and the legs while maintaining the back straight; and simultaneously holding the foot board system in place and the distal tip of the foot board end in contact with the floor.

35. The method of claim 1 wherein:

the configuring step further comprises:

arranging the apparatus in a second configuration, wherein the first end of the resistance band is secured to a securing location on the foot board end of the elongated member, and the second end of the resistance band is secured to a securing location on the handle end of the hollow member; and the positioning step further comprises:

securing one foot into the foot board system; and lying supine on a floor; and grasping a handle with the hand opposite the one foot; and bending the leg of the one foot so that the knee is at about the level of the waist; and bending the arm of the hand opposite the one foot so that the hand is at about the level of the face; and the performing step further comprises:

pushing the foot board system toward the distal end using the leg of the one foot; and simultaneously pushing the handle toward the proximal end using the arm.

* * * * *